US008232942B2

(12) United States Patent
Hashimoto

(10) Patent No.: US 8,232,942 B2
(45) Date of Patent: Jul. 31, 2012

(54) LIQUID CRYSTAL DISPLAY AND DRIVING METHOD THEREOF

(75) Inventor: Yoshiharu Hashimoto, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 728 days.

(21) Appl. No.: 12/320,977

(22) Filed: Feb. 10, 2009

(65) Prior Publication Data

US 2009/0153452 A1 Jun. 18, 2009

Related U.S. Application Data

(63) Continuation of application No. 11/023,688, filed on Dec. 29, 2004, now Pat. No. 7,554,520.

(30) Foreign Application Priority Data

Jan. 8, 2004 (JP) ..... 2004-003463

(51) Int. Cl.
*G09G 3/36* (2006.01)

(52) U.S. Cl. ..... 345/87; 345/99

(58) Field of Classification Search ..... 345/83, 345/87–103, 205
See application file for complete search history.

(56) References Cited

U.S. PATENT DOCUMENTS 5,710,571 A * 1/1998 Kuo ..... 345/94
6,333,729 B1 12/2001 Ha
6,577,290 B2 6/2003 Yeo
6,980,190 B2 12/2005 Ueda
2001/0043178 A1 11/2001 Okuzono et al.
2002/0089485 A1* 7/2002 Youn ..... 345/99
2003/0043097 A1* 3/2003 Shingai et al. ..... 345/87
2003/0067429 A1* 4/2003 Aoki et al. ..... 345/87
2005/0052439 A1* 3/2005 Liou ..... 345/204

FOREIGN PATENT DOCUMENTS

JP 7-13513 1/1995
JP 7-146666 6/1995

(Continued)

OTHER PUBLICATIONS

Japanese Office Action dated Mar. 24, 2010 with partial English translation thereof.

(Continued)

*Primary Examiner* — Quan-Zhen Wang
*Assistant Examiner* — Yuk Chow
(74) *Attorney, Agent, or Firm* — McGinn IP Law Group, PLLC

(57) ABSTRACT

A liquid crystal display includes scanning lines organized in sets of at least two, data lines overlapping the scanning lines at intersection regions, pixels located at the overlaps, a scanning line driver sequentially scanning the sets of scanning lines, a data line driver applying a voltage corresponding to an image data to each pixel through a corresponding data line, and a common electrode applying a reference voltage to the pixels. The sets of scanning lines each include adjacent first and second scanning lines. First and second pixels are associated with the first and second scanning lines, respectively. The scanning line driver drives the second pixel after the first pixel in a first period and the first pixel after the second pixel in a second period. The data line driver inverts a polarity of the pixel voltage with regard to the reference voltage every N horizontal scanning periods (N is an integer equal to or larger than 2).

20 Claims, 18 Drawing Sheets

FOREIGN PATENT DOCUMENTS

| | | |
|---|---|---|
| JP | 7-168542 | 7/1995 |
| JP | 7-219483 | 8/1995 |
| JP | 9-171168 | 6/1997 |
| JP | 11-352938 | 12/1999 |
| JP | 2000-250486 | 9/2000 |
| JP | 2000-250496 | 9/2000 |
| JP | 2001-215469 | 8/2001 |
| JP | 2002-162928 | 6/2002 |
| JP | 2002-215117 | 7/2002 |
| JP | 2002-244623 | 8/2002 |
| JP | 2002-287701 | 10/2002 |
| JP | 2003-114651 | 4/2003 |
| JP | 2003-207760 | 7/2003 |

OTHER PUBLICATIONS

Japanese Office Action dated Jun. 1, 2010, with partial English translation.

* cited by examiner

LIQUID CRYSTAL DISPLAY AND DRIVING METHOD THEREOF

The present application is a continuation application of U.S. patent application Ser. No. 11/023,688, filed on Dec. 29, 2004 now U.S. Pat. No. 7,554,520, and claims benefit of priority from Japanese Application No. 2004-003463, filed Jan. 8, 2004.

BACKGROUND OF THE INVENTION

1. Field of the Invention

The present invention is generally related to a liquid crystal display and a method of driving the liquid crystal display. More specifically, the present invention is related to an active matrix type liquid crystal display, and a driving method thereof.

2. Description of the Related Art

An active matrix liquid crystal display (AMLCD) is known in the technical field. The active matrix liquid crystal display has a plurality of pixels which are arranged in a matrix form. Active devices such as TFTs (Thin Film Transistor) are provided for respective of the plurality of pixels. A gate electrode of each active device is connected to a scanning line formed along a row direction, and a drain electrode of each active device is connected to a data line formed along a column direction. The liquid crystal display scans the scanning lines sequentially from top to bottom of a display panel, to display an image on the display panel (namely, line sequential method). Such an operation for displaying a single image is referred to as a "frame (field)".

In the liquid crystal display within the public domain, a voltage is applied to the pixel through the data line. The voltage is referred to as a "pixel voltage" hereinafter. A polarity of the pixel voltage is inverted every predetermined period. Thus, the pixel is driven in an AC (Alternating Current) manner. Here, the polarity indicates whether the pixel voltage is positive or negative with regard to a voltage of a common electrode as a reference voltage. The above-mentioned driving method is applied in order to suppress the deterioration of a liquid crystal material. For instance, the polarity of the pixel voltage is inverted every time two scanning lines are scanned (2-line inversion driving method). That is to say, assuming now that a first scanning line is scanned after the polarity of the pixel voltage is inverted, the next scanning line (namely, a second scanning line) is scanned with the same polarity, and then the polarity is inverted again. Due to the 2-line inversion driving method, the flicker can be reduced and the image quality can be improved.

The increase in size of the liquid crystal display causes the increase in parasitic capacitance and parasitic resistance. As a result, a waveform of drive voltage applied to the data line is rounded. Also, as the resolution of the liquid crystal display panel becomes higher, the time during which the pixel voltage is applied to the pixel becomes shorter (the time is referred to as a "writing period" hereinafter). These facts may cause that in the 2-line inversion driving method, a voltage (holding voltage) which is written to a pixel connected to the first scanning line becomes lower than a voltage which is written to another pixel connected to the second scanning line. When the holding voltage of the pixel becomes lower, the luminance of the pixel also becomes lower. Thus, a difference in the luminance between adjacent scanning lines appears as a lateral stripe on a display screen. For suppressing the occurrence of such a lateral stripe, the following techniques have been proposed; Japanese Laid Open Patent Application No. 2001-215469 (referred to as patent document No. 1 hereinafter) and Japanese Laid Open Patent Application No. 2002-287701 (referred to as patent document No. 2 hereinafter).

According to liquid crystal displays disclosed in the patent document No. 1 and the patent document No. 2, the writing period T1 with respect to a pixel connected to a first scanning line is designed to be longer than the writing period T2 with respect to a pixel connected to a second scanning line. Therefore, the luminance of the pixel connected to the second scanning line can be suppressed nearly to the luminance of the pixel connected to the first scanning line. As a consequence, the occurrence of a lateral stripe on a display screen may be suppressed, although the contrast deteriorates.

Also, according to the liquid crystal display disclosed in the patent document No. 2, when the second scanning line is scanned, a precharge voltage which is intermediate between a voltage of a positive electrode and a voltage of a negative electrode is once applied to the pixel (precharging operation), and then a predetermined pixel voltage is applied to this pixel. As a result, the occurrence of the lateral stripe on the display screen may be suppressed. However, currents are consumed in the precharging operation, and thus the power consumption is increased.

SUMMARY OF THE INVENTION

Therefore, an object of the present invention is to provide a liquid crystal display and a method of driving the liquid crystal display which can suppress an occurrence of a lateral stripe on a display screen when displaying an image on the display screen.

Another object of the present invention is to provide a liquid crystal display and a method of driving the liquid crystal display which can suppress an occurrence of a lateral stripe on a display screen without adjusting the writing period.

Still another object of the present invention is to provide a liquid crystal display and a method of driving the liquid crystal display which can improve contrast of an image displayed on a screen.

Still another object of the present invention is to provide a liquid crystal display and a method of driving the liquid crystal display which can reduce power consumption.

In an aspect of the present invention, a liquid crystal display includes a plurality of scanning lines, a plurality of data lines overlapping the plurality of scanning lines at a plurality of intersection regions, and a plurality of pixels located at the plurality of intersection regions. The liquid crystal display further includes a scanning line driver configured to drive the plurality of pixels by sequentially scanning the plurality of scanning lines, and a data line driver configured to apply a pixel voltage corresponding to an image data to each of the plurality of pixels through corresponding one of the plurality of data lines. The plurality of scanning lines include a first scanning line and a second scanning line. The plurality of pixels include a first pixel associated with the first scanning line and a second pixel associated with the second scanning line. According to the present invention, the scanning line driver drives the second pixel after the first pixel in a first period, and drives the first pixel after the second pixel in a second period. That is to say, the scanning order is reversed between the first period and the second period.

The first period includes a first frame and a second frame, and the second period includes a third frame and a fourth frame. In this case, the scanning line driver drives the second pixel after the first pixel in each of the first frame and the second frame. Also, the scanning line driver drives the first pixel after the second pixel in each of the third frame and the fourth frame.

It is preferable in the present invention that the first scanning line and the second scanning line are located adjacent to each other.

The liquid crystal display further includes a common electrode configured to apply a reference voltage to the plurality of pixels. In this case, the data line driver can invert a polarity of the pixel voltage with regard to the reference voltage every frame (frame inversion driving method). Also, the data line driver can invert a polarity of the pixel voltage with regard to the reference voltage every N horizontal scanning periods (N is an integer equal to or larger than 2; N-line inversion driving method). The N can be 2 (2-line inversion driving method). It should be noted that the horizontal scanning period is defined by a period for which the scanning line driver scans one scanning line.

Also, the plurality of data lines include a first data line and a second data line adjacent to the first data line. In this case, the data line driver applies the pixel voltage such that a polarity of the pixel voltage applied to the first data line is opposite to a polarity of the pixel voltage applied to the second data line with regard to the reference voltage (dot inversion driving method).

In the liquid crystal display, the scanning line driver includes a shift register. A number of the plurality of scanning lines is 2M (M is a natural number), and the shift register has 2M flip-flop circuits and 2M output lines.

Outputs of the 2M flip-flop circuits can be connected to the plurality of scanning lines through the 2M output lines, respectively. In this case, an input and an output of a 2i-th (i is an integer not less than 1 and not more than M−1) flip-flop circuit are connected to an output of a (2i−1)-th flip-flop circuit and an input of a (2i+1)-th flip-flop circuit in the first period, respectively. An input and an output of the (2i−1)-th flip-flop circuit are connected to an output of the 2i-th flip-flop circuit and an input of a (2i+2)-th flip-flop circuit in the second period, respectively.

Also, the 2M flip-flop circuits can be serially connected, and the 2M output lines can be connected to the plurality of scanning lines, respectively. In this case, an output of a (2i−1)-th (i is an integer not less than 1 and not more than M) flip-flop circuit is connected to a (2i−1)-th output line and an output of a 2i-th flip-flop circuit is connected to a 2i-th output line in the first period. The output of the (2i−1)-th flip-flop circuit is connected to the 2i-th output line and the output of the 2i-th flip-flop circuit is connected to the (2i−1)-th output line in the second period.

Due to the above-mentioned configuration of the scanning line driver, the scanning order is reversed between the first period and the second period.

In the liquid crystal display, the data line driver can include a first line memory, a second line memory, a latch circuit and a switching circuit. The first line memory is configured to store a first image data as the image data associated with the first scanning line. The second line memory is configured to store a second image data as the image data associated with the second scanning line. The latch circuit is configured to output the image data to the plurality of data lines. The switching circuit is configured to select any of the first line memory and the second line memory as a selected line memory, and output the image data stored in the selected line memory to the latch circuit. Here, the switching circuit selects the second line memory after the first line memory in the first period. Also, the switching circuit selects the first line memory after the second line memory in the second period.

The liquid crystal display may further has a controller configured to supply the image data to the data line driver. The image data includes a first image data associated with the first scanning line and a second image data associated with the second scanning line. In the first period, the controller supplies the second image data after the first image data to the data line driver. In the second period, the controller supplies the first image data after the second image data to the data line driver.

In another aspect of the present invention, a method of driving the liquid crystal display includes: (A) scanning the second scanning line after the first scanning line; and (B) scanning the first scanning line after the second scanning line. It is preferable that the above-mentioned (A) scanning and the above-mentioned (B) scanning are carried out alternately every two frames.

According to the liquid crystal display and the method of driving the liquid crystal display of the present invention, an occurrence of a lateral stripe on a display screen is suppressed when an image is displayed on the display screen.

According to the liquid crystal display and the method of driving the liquid crystal display of the present invention, an occurrence of a lateral stripe on a display screen is suppressed without adjusting the writing period.

According to the liquid crystal display and the method of driving the liquid crystal display of the present invention, contrast of an image displayed on a screen is improved.

According to the liquid crystal display and the method of driving the liquid crystal display of the present invention, power consumption is reduced.

DESCRIPTION OF THE PREFERRED EMBODIMENTS

Referring now to the accompanying drawings, a liquid crystal display and a method of driving the liquid crystal display according to the present invention will be described below.

Figure 1:
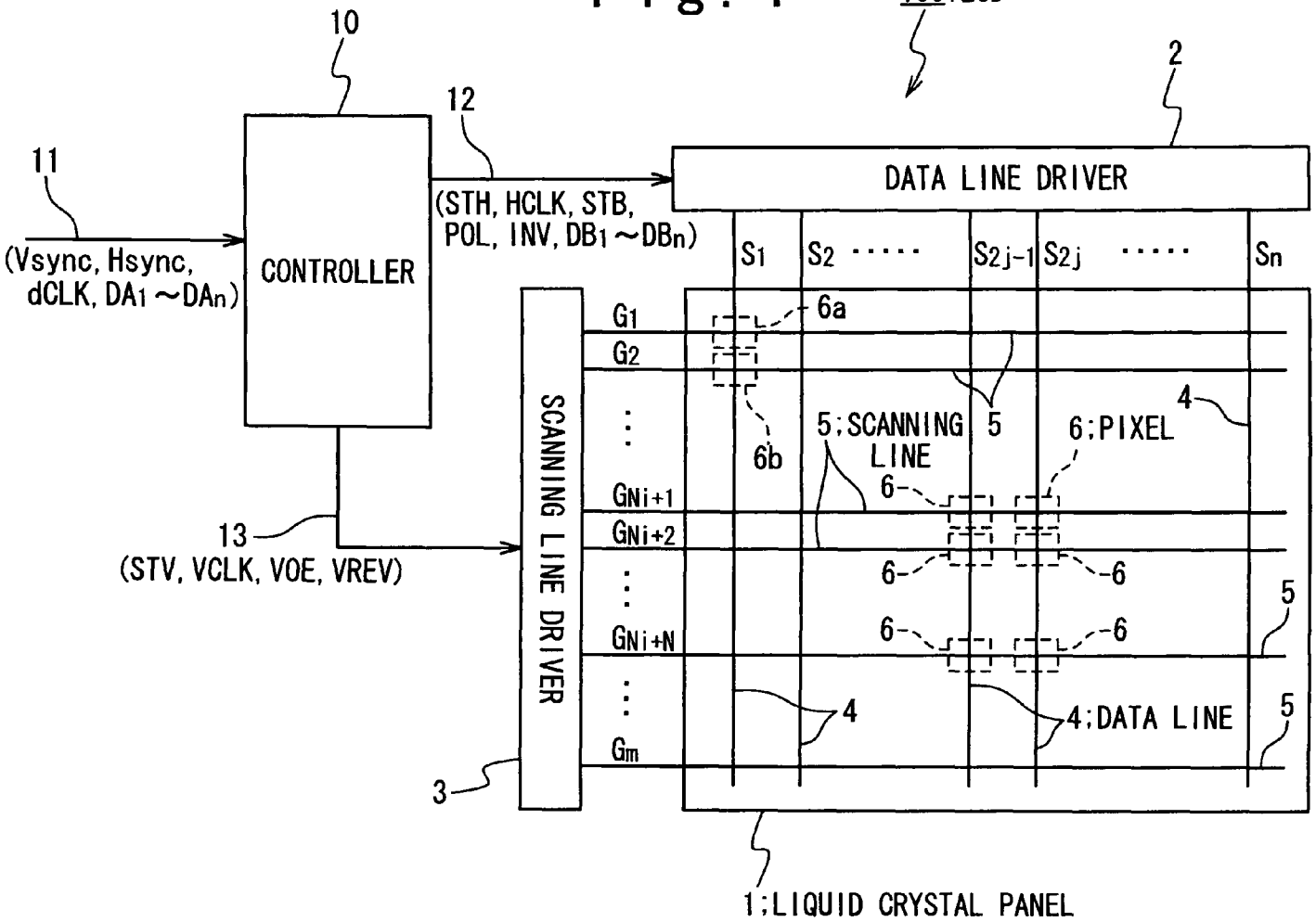
FIG. 1 is a block diagram showing a configuration of a liquid crystal display according to the present invention.

FIG. 1 is a block diagram showing a configuration of a liquid crystal display (LCD) 100 according to the present invention. In FIG. 1, the liquid crystal display 100 has a liquid crystal panel 1, a data line driver 2, a scanning line driver 3, a plurality of data lines 4, and a plurality of scanning lines 5. Each of the plurality of data lines 4 is arranged to intersect with the plurality of scanning lines 5 on the liquid crystal panel 1. That is to say, the plurality of data lines 4 overlap the plurality of scanning lines 5 at a plurality of intersection regions. A plurality of pixels 6 are located at the plurality of intersection regions, respectively. The data line driver 2 is connected to the plurality of data lines 4, and the scanning line driver 3 is connected to the plurality of scanning lines 5.

In FIG. 1, the plurality of scanning lines 5 are arranged along a row direction. The number of the scanning lines 5 is m (m is an integer larger than 1). Respective of the plurality of scanning lines 5 are referred to as a scanning line $G_1$, $G_2$, - - - , $G_m$ in this order from top to bottom. Also, the plurality of data lines 4 are arranged along a column direction. The number of the data lines 4 is n (n is an integer larger than 1). Respective of the plurality of data lines 4 are referred to as a data line $S_1$, $S_2$, - - - , $S_n$ in this order from left to right. Thus, the plurality of pixels 6 are arranged in an "m×n" matrix form. For instance, the liquid crystal display 100 has 1080×1920 pixels 6.

The liquid crystal display 100 further has a controller 10. An input signal group 11 is supplied to this controller 10. The controller 10 generates a data line driving signal group 12 on the basis of the input signal group 11, and outputs the data line driving signal group 12 to the data line driver 2. Also, the controller 10 generates a scanning line driving signal group 13 on the basis of the input signal group 11, and outputs the scanning line driving signal group 13 to the scanning line driver 3. The data line driving signal group 12 and the scanning line driving signal group 13 are signal groups which are used for controlling the data line driver 2 and the scanning line driver 3, respectively.

As will be explained later, the input signal group 11 includes a vertical synchronizing signal "$V_{sync}$" (will be simply referred to as a "vertical sync signal" hereinafter), a horizontal synchronizing signal "$H_{sync}$" (will be simply referred to as a "horizontal sync signal" hereinafter), a dot clock signal "dCLK", and image signals (image data) "DA1" to "DAn." Also, the data line driving signal group 12 includes a horizontal start signal "STH", a horizontal clock signal "HCLK", a latch signal "STB", a polarity inverting signal "POL", a data inverting signal "INV", and image signals (image data) "DB1" to "DBn." Also, the scanning line driving signal group 13 includes a scan start signal "STV", a scan clock signal "VCLK", an output enable signal "VOE", and a scanning reversal signal "VREV."

Figure 2:
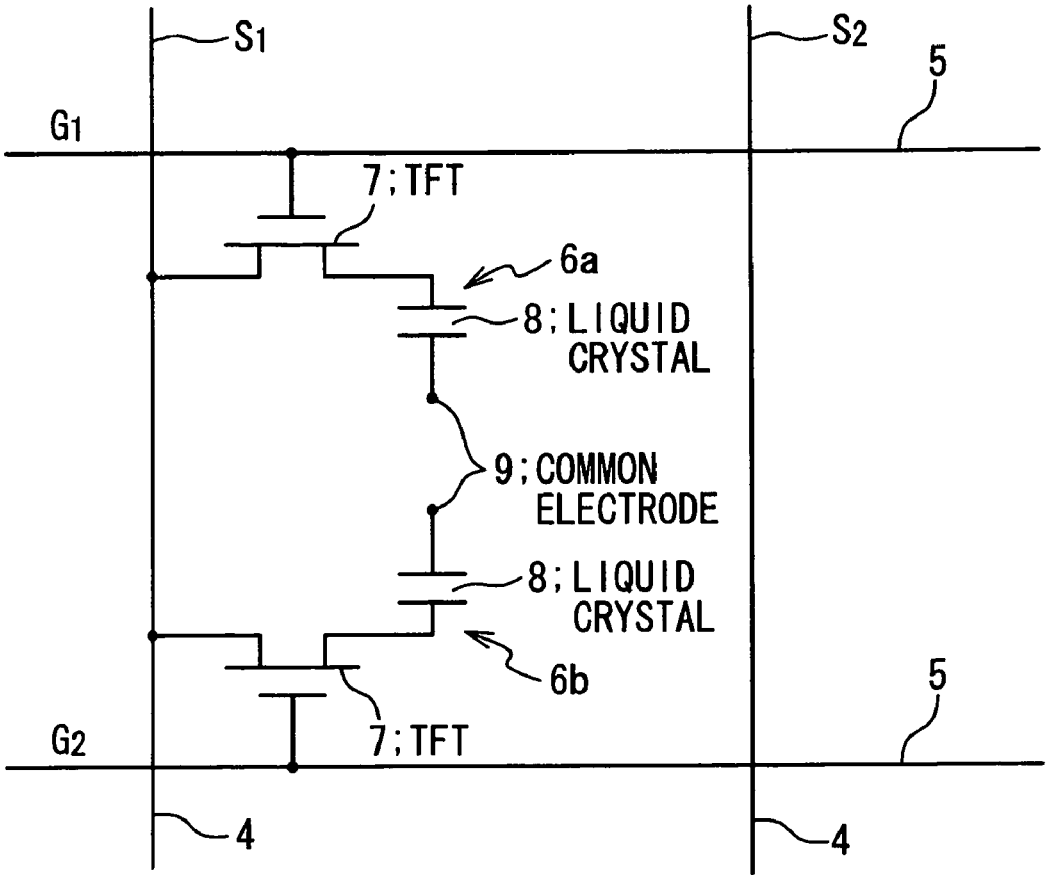
FIG. 2 is a schematic diagram showing a structure of a pixel of the liquid crystal display according to the present invention.

FIG. 2 is a schematic diagram showing a configuration of the pixels 6 of the liquid crystal display 100. Shown in FIG. 2 are, for example, a pixel 6*a* (first pixel) associated with the data line $S_1$ and the scanning line $G_1$ (first scanning line), and a pixel 6*b* (second pixel) associated with the data line $S_1$ and the scanning line $G_2$ (second scanning line). As shown in FIG. 2, each of the pixels 6 (6*a*, 6*b*) has a TFT (Thin Film Transistor) 7, liquid crystal 8, a common electrode 9, and a auxiliary capacitor (not shown). A predetermined voltage "$V_{com}$" (referred to as a reference voltage "$V_{com}$" hereinafter) is applied to the common electrode 9. The reference voltage $V_{com}$ is applied to one end of the liquid crystal 8 by the common electrode 9. A source of the TFT 7 is connected to the other end of the liquid crystal 8. A gate electrode and a drain of the TFT 7 are connected to the scanning line 5 and the data line 4, respectively.

In the active matrix type liquid crystal display 100, the scanning line driver 3 sequentially scans the plurality of scanning lines 5 in response to the above-mentioned scanning line driving signal group 13. A TFT 7 which is connected to a scanning line 5 under the scanning operation is turned on. At this time, a "pixel voltage" is applied via the data line 4 to the pixel 6 by the data line driver 2. The pixel voltage corresponds to the image data supplied to the data line driver 2. In this manner, the plurality of pixels 6 are driven. The pixel 6 holds a provided voltage as a "holding voltage" for one frame period. Since luminance of the pixel 6 depends on the level of the holding voltage, it is possible to display an image with a desired gradation by controlling the pixel voltage applied to the data line 4. When all of the plurality of scanning lines 5 are scanned, one frame is completed. By repeating the frame, images are continuously displayed on the liquid crystal panel 1. For example, the liquid crystal display 100 is driven at a frequency of 60 frames per 1 second (60 Hz).

Figure 3:
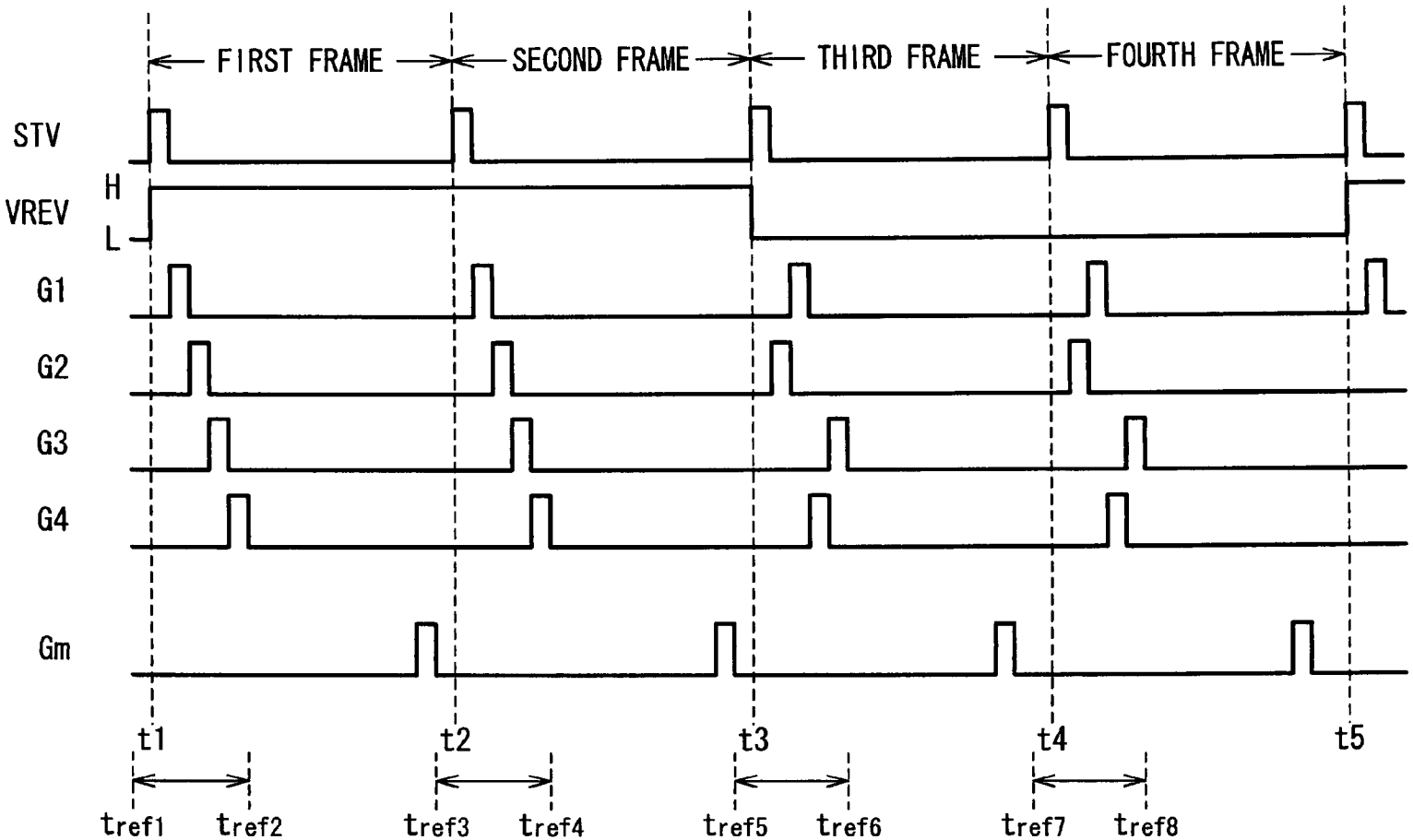
FIG. 3 is a timing chart showing an operation of the liquid crystal display according to the present invention.

FIG. 3 is a timing chart schematically showing an operation of the liquid crystal display 100 according to the present invention. Shown in FIG. 3 are waveforms of scanning voltages applied to respective of the plurality of scanning lines $G_1$ to $G_m$ during 4 successive frames (first frame, second frame, third frame, and fourth frame). These scanning voltages are outputted from the scanning line driver 3 in response to the scanning line driving signal group 13. The scan start signal STV and the scanning reversal signal VREV are also shown in FIG. 3. The scan start signal STV is a signal for indicating a start of each frame. The scanning reversal signal VREV is a signal for indicating a "scanning mode", as will be described later. When the scanning reversal signal VREV is set in a high level (referred to as "H" hereinafter), the plurality of scanning lines $G_1$ to $G_m$ are scanned in a "first mode". On the other hand, when the scanning reversal signal VREV is set in a low level (referred to as "L" hereinafter), the plurality of scanning lines $G_1$ to $G_m$ are scanned in a "second mode".

At the time t1, the controller 10 outputs the scan start signal STV to the scanning line driver 3. As a result, the first frame starts. At the same time (namely, at the time t1), the scanning reversal signal VREV reverses from "L" (second mode) to "H" (first mode). In the first frame, as shown in FIG. 3, the scanning line driver 3 sequentially scans from the scanning line $G_1$ to the scanning line $G_m$ one by one in an order of the line number. That is to say, in the first mode, the plurality of scanning lines $G_1$ to $G_m$ are sequentially scanned one by one in the order of the line number.

After all of the scanning lines $G_1$ to $G_m$ are once scanned, the controller 10 outputs the scan start signal STV to the scanning line driver 3 at the time t2. As a result, the second frame starts. As in the case of the first frame, the scanning line driver 3 sequentially scans from the scanning line $G_1$ to the scanning line $G_m$ one by one in the order of the line number. The scanning reversal signal VREV remains in the "H" level during the second frame.

At the time t3, the controller 10 outputs the scan start signal STV to the scanning line driver 3. As a result, the third frame starts. At the same time (namely, at the time t3), the scanning reversal signal VREV reverses from "H" (first mode) to "L" (second mode). In the third frame, as shown in FIG. 3, the scanning line driver 3 sequentially scans the plurality of scanning lines one by one in an order of the scanning line $G_2$, the scanning line $G_1$, the scanning line $G_4$, the scanning line $G_3$, - - - . In other words, in the second mode, a pair of scanning lines (a first scanning line and a second scanning line) is scanned in an opposite order with respect to the order in the first mode.

At the time t4, the controller 10 outputs the scan start signal STV to the scanning line driver 3. As a result, the fourth frame starts. As in the case of the third frame, the scanning line driver 3 sequentially scans the plurality of scanning lines one by one in the order of the scanning line $G_2$, the scanning line $G_1$, the scanning line $G_4$, the scanning line $G_3$, - - - . The scanning reversal signal VREV remains in the "L" level during the second frame.

At the time t5, the next frame starts and the scanning reversal signal VREV reverses from "L" to "H". Subsequently, operations similar to the above-described operations from the first frame to the fourth frame are repeatedly carried out.

As described above, according to the liquid crystal display 100 of the present invention, the scanning order is reversed between the first mode and the second mode. The first mode is associated with a first period including the first frame and the second frame. The second mode is associated with a second period including the third frame and the fourth frame. In the first mode (first period), the scanning line driver 3 drives a first pixel 6 corresponding to a first scanning line (for example, $G_1$), and then drives a second pixel 6 corresponding to a second scanning line (for instance, $G_2$). In the second mode (second period), the scanning line driver 3 drives the second pixel 6 corresponding to the second scanning line, and then drives the first pixel 6 corresponding to the first scanning line (for instance, $G_1$). The scanning operation in the first mode and the scanning operation in the second mode are carried out alternately every two frames.

Figure 4A:
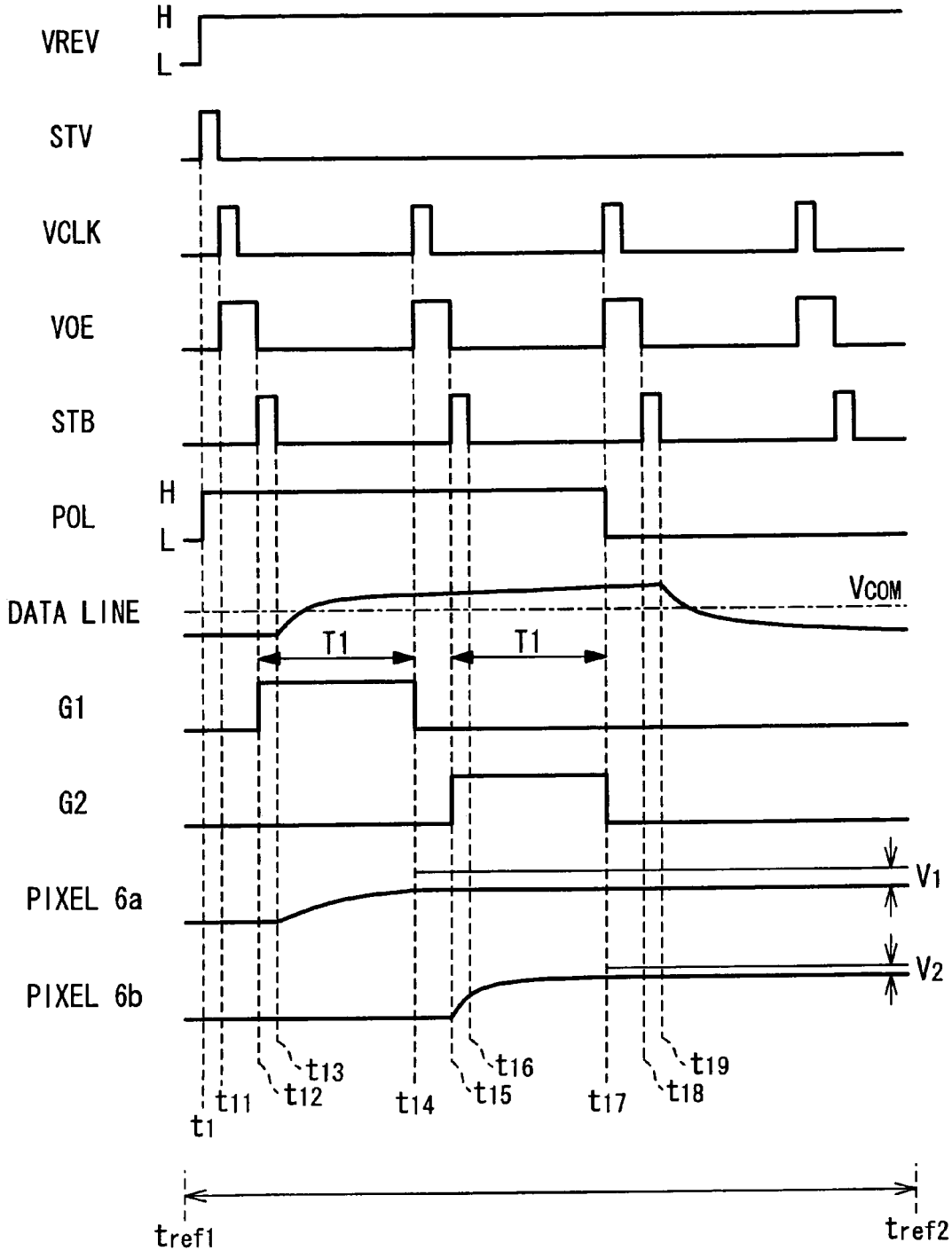
FIG. 4A is a timing chart showing an operation in a first frame according to the present invention.
Figure 4B:
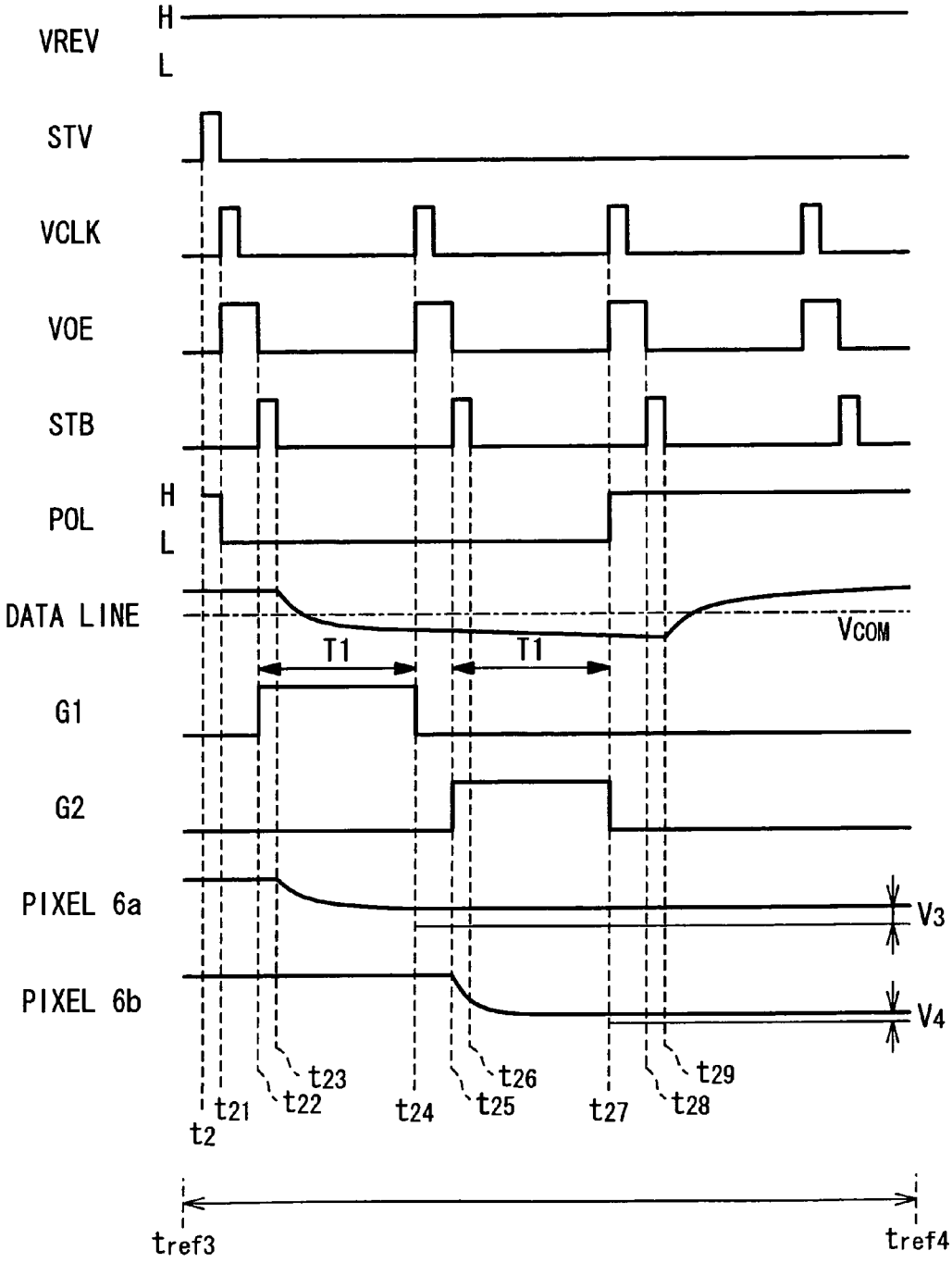
FIG. 4B is a timing chart showing an operation in a second frame according to the present invention.
Figure 4C:
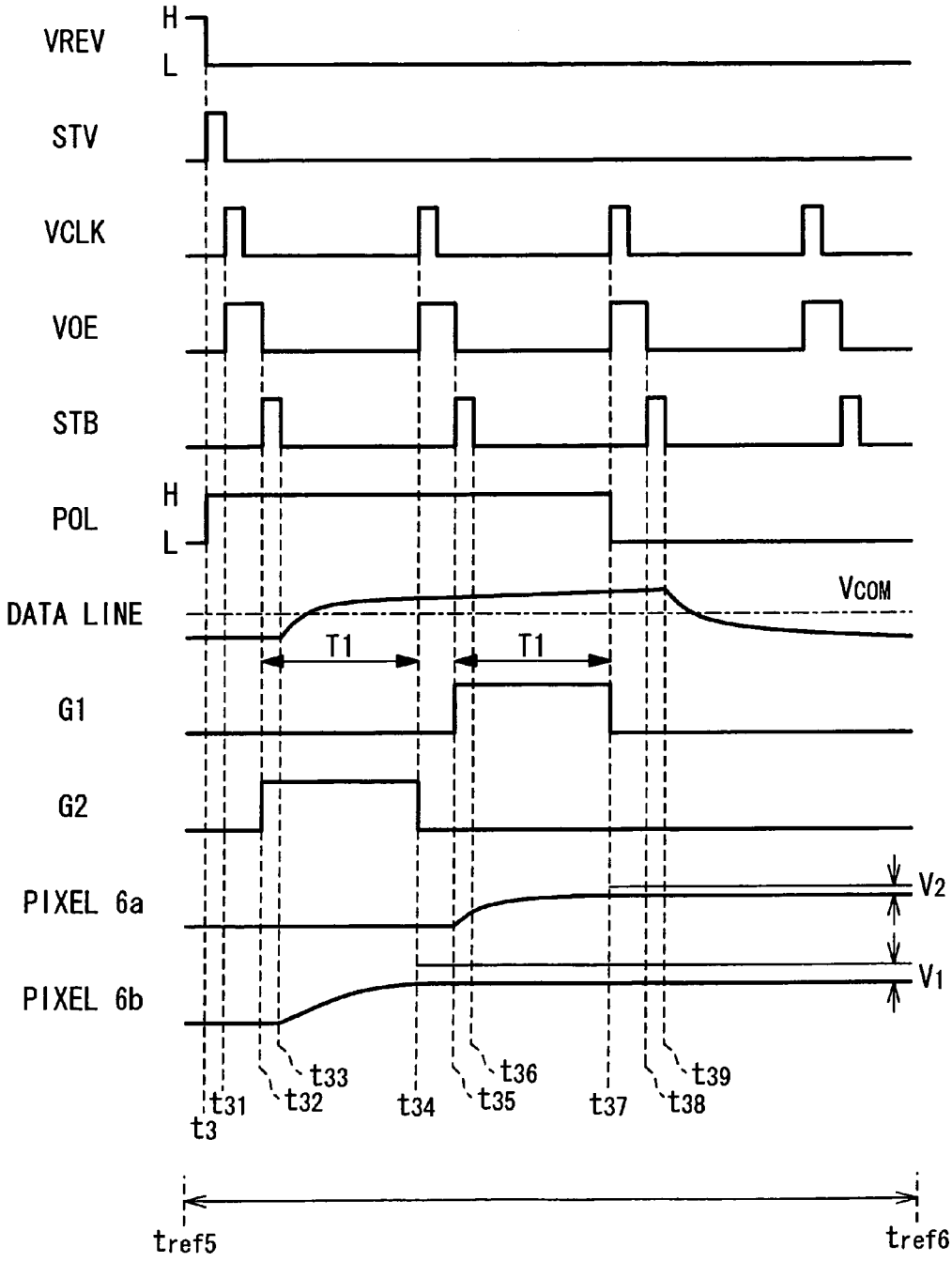
FIG. 4C is a timing chart showing an operation in a third frame according to the present invention.
Figure 4D:
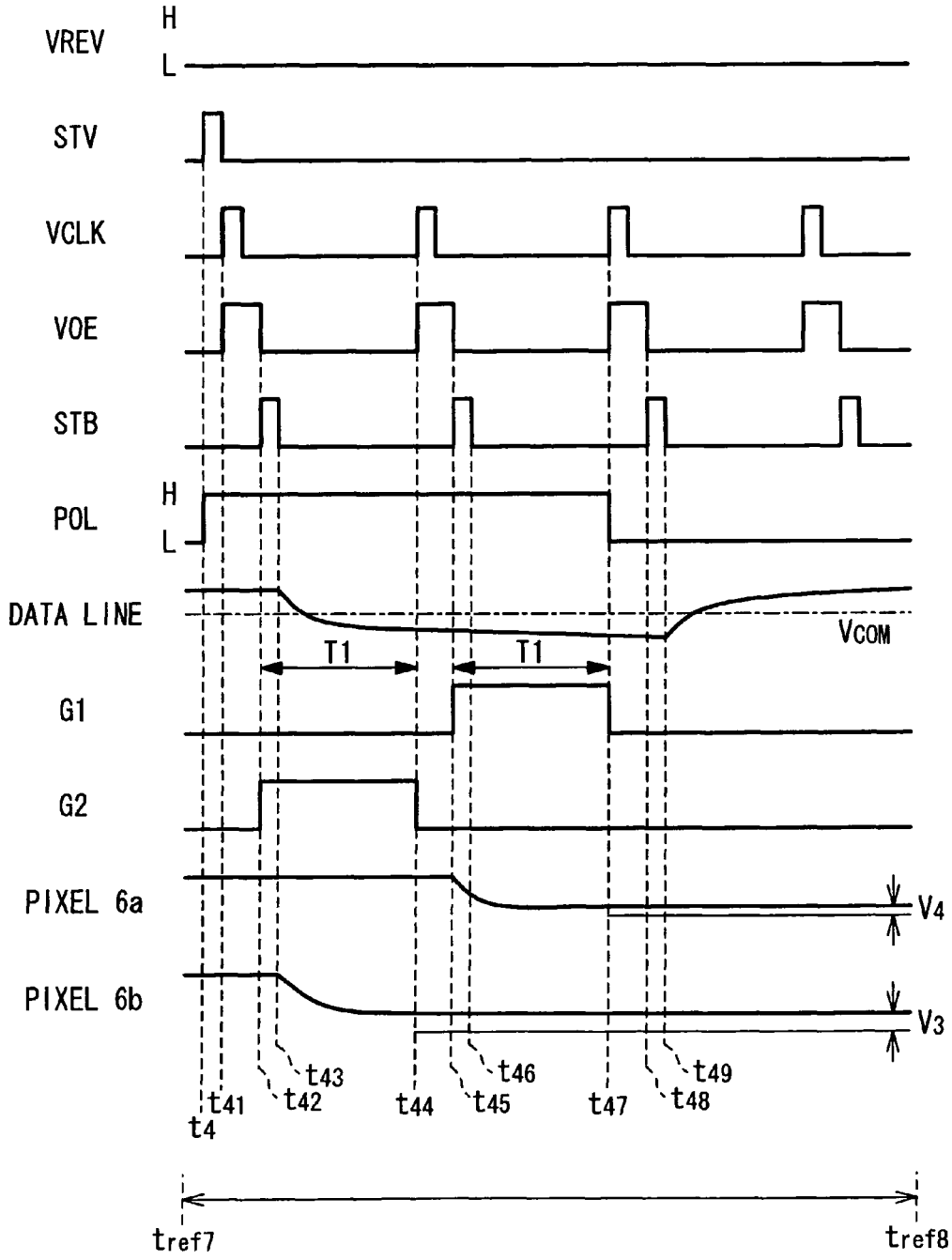
FIG. 4D is a timing chart showing an operation in a fourth frame according to the present invention.

Next, a detailed explanation is made of the operations of the liquid crystal display 100 according to the present invention. FIG. 4A is a timing chart for explaining the detailed operations in a time period from $t_{ref1}$ to $t_{ref2}$ (refer to FIG. 3) which includes the time t1. Similarly, FIG. 4B, FIG. 4C and FIG. 4D are timing charts for explaining the detailed operations in a time period from $t_{ref3}$ to $t_{ref4}$ including the time t2, in a time period from $t_{ref5}$ to $t_{ref6}$ including the time t3, and in a time period from $t_{ref7}$ to $t_{ref8}$ including the time t4.

Shown in FIG. 4A are the scanning reversal signal VREV, the scan start signal STV, the scan clock signal VCLK, the output enable signal VOE, the latch signal STB, the polarity inverting signal POL, a pixel voltage (data line waveform) which is applied to the data line $S_1$, a scanning voltage ($G_1$ waveform) applied to the scanning line $G_1$, a scanning voltage ($G_2$ waveform) applied to the scanning line $G_2$ which is located adjacent to the scanning line $G_1$, a voltage which is applied to the pixel 6*a*, and a voltage which is applied to the pixel 6*b*. Shown in this example is an operation of displaying a black screen in a normally white type liquid crystal panel, in which the difference in drive voltage is largest.

The scan clock signal VCLK corresponds to a clock signal which controls scanning operations of the scanning lines $G_1$ to $G_m$, which is generated by the controller 10 in response to the vertical sync signal $V_{sync}$ and is outputted to the scanning line driver 3. The output enable signal VOE corresponds to a signal which controls outputs (scanning voltages) of the scanning line driver 3, which is outputted from the controller 10 to the scanning drive circuit 3. When the level of the output enable signal VOE is "H", the output of the scanning line driver 3 is fixed to "L". The latch signal STB corresponds to a signal which indicates a timing of switching the pixel voltages applied to the data lines $S_1$ to $S_n$, which is outputted from the controller 10 to the data line driver 2. The polarity inverting signal POL corresponds to a signal which indicates a polarity of the pixel voltage, which is outputted from the controller 10 to the data line driver 2. Here, the "polarity" indicates whether the pixel voltage is positive or negative with regard to the reference voltage $V_{com}$ at the common electrode 9. It is assumed that the polarity of the pixel voltage applied to the data line $S_1$ is negative before the time t1.

As shown in FIG. 4A, the scan start signal STV rises at the time t1. In synchronization with that, the scanning reversal signal VREV is set to "H" (first mode). At the time t11, the scan clock signal VCLK, the output enable signal VOE and the polarity inverting signal POL rise. Since the scan clock signal VCLK rises, a "horizontal period (horizontal scanning period)" during which one scanning line 5 is scanned starts. In this case, a horizontal period with respect the scanning line $G_1$ is commenced. Since the level of the output enable signal VOE is "H", the scanning line driver 3 does not yet output a scanning voltage.

At the time t12, the level of the output enable signal VOE changes from "H" to "L", and hence a scanning voltage is applied to the scanning line $G_1$ by the scanning line driver 3. As a result, the writing of the voltage with respect to the pixel 6*a* begins. The latch signal STB indicative of the switching timing of the pixel voltage falls at the time t13. Here, the level of the polarity inverting signal POL is "H". Therefore, the polarity of the pixel voltage applied to the data line $S_1$ begins to change from negative to positive.

As shown in FIG. 4A, the pixel voltage (data line waveform) changes gradually due to the parasitic capacitance and the parasitic resistance of the data line 4. The voltage applied to the pixel 6*a* also changes gradually according to the change in the pixel voltage.

At the time t14, the scan clock signal VCLK and the output enable signal VOE rise. In accordance with that, the application of the scanning voltage to the scanning line $G_1$ ends. As described above, the horizontal period with respect to the scanning line $G_1$ starts at the time t11 and ends at the time t14. A period during which the TFT 7 of the pixel 6*a* is turned ON, namely the voltage writing period for the pixel 6*a* starts at the time t12 and ends at the time t14. The duration of the writing operation is "T1". The pixel 6*a* holds the voltage being applied at the time t14 as the "holding voltage". The holding voltage is held by the pixel 6*a* for one frame period. It should be noted that, as shown in FIG. 4A, the pixel voltage applied to the data line $S_1$ is still changing at the time t14. In other words, the pixel voltage has not yet changed for a predetermined range (approximately 10 V) within one horizontal period. Therefore, the holding voltage of the pixel 6*a* does not yet reach a maximum value. The difference between the holding voltage of the pixel 6*a* and the maximum value is referred to as "V1", as indicated in FIG. 4A. The difference voltage V1 becomes more conspicuous, as the size of the liquid crystal display 100 becomes larger and its resolution becomes higher.

Since the scan clock signal VCLK rises at the time t14, a horizontal period with respect the scanning line $G_2$ is commenced. Since the level of the output enable signal VOE is "H", the scanning line driver 3 does not yet output a scanning voltage. At the time t15, the level of the output enable signal VOE changes from "H" to "L", and hence a scanning voltage is applied to the scanning line $G_2$. As a result, the writing of the voltage with respect to the pixel 6*b* begins. Thus, the output enable signal VOE plays a role of preventing the interference between a writing operation for a pixel 6 (pixel 6*a*) in a certain horizontal period and another writing operation for another pixel 6 (pixel 6*b*) in the next horizontal period. The latch signal STB falls at the time t16. Here, the level of the polarity inverting signal POL is still "H". Therefore, the polarity of the pixel voltage applied to the data line $S_1$ remains in positive.

At the time t17, the scan clock signal VCLK and the output enable signal VOE rise. In accordance with that, the horizontal period and the writing period with respect to the scanning line $G_2$ end. The pixel 6*b* holds the voltage being applied at the time t17 as the holding voltage. The holding voltage is held by the pixel 6*b* for one frame period. The difference between the holding voltage of the pixel 6*b* and the maximum value is referred to as "V2", as indicated in FIG. 4A. It should be noted that the difference voltage V2 is smaller than the difference voltage V1 because the polarity inverting signal POL is constant during the horizontal periods for both the pixel 6*a* and the pixel 6*b*.

Also, the level of the polarity inverting signal POL changes from "H" to "L" at the time t17. Thereafter, the latch signal STB falls at the time t19. In response to that, the polarity of the pixel voltage applied to the data line $S_1$ begins to change from positive to negative as shown in FIG. 4A. In this example, the polarity of the pixel voltage applied to the data lines $S_1$ to $S_n$ is inverted every 2 horizontal periods (2-line inversion driving method). Also, when the level of the polarity inverting signal POL is "H", the data line driver 2 may apply the pixel voltage with the positive polarity to an odd-numbered data line $S_{2j-1}$ (j is a natural number) and apply the pixel voltage with the negative polarity to an even-numbered data line $S_{2j}$. On the other hand, when the level of the polarity inverting signal POL is "L", the data line driver 2 may apply the pixel voltage with the negative polarity to an odd-numbered data line $S_{2j-1}$ and apply the pixel voltage with the positive polarity to an even-numbered data line $S_{2j}$ (dot inversion driving method). The 2-line inversion driving method, the dot inversion driving method, and a combination of them are preferable in that the deterioration of the liquid crystal material can be suppressed when driving the liquid crystal display 100.

FIG. 4B shows operations of the liquid crystal display 100 in the second frame. In FIG. 4B, the same parameters as in FIG. 4A are shown, and overlapping explanations will be properly omitted. At the time t2, the scan start signal STV rises, and hence the second frame is commenced. At the time t21, the scan clock signal VCLK and the output enable signal VOE rise, and the level of the polarity inverting signal POL is set to "L". As described above, the polarity of the pixel voltage applied to the data lines $S_1$ to $S_n$ is inverted every frame (frame inversion driving method). The frame inversion driving method is also preferable in that the deterioration of the liquid crystal material can be suppressed when driving the liquid crystal display 100. Since the scan clock signal VCLK rises, a horizontal period with respect to the scanning line $G_1$ starts.

At the time t22, the level of the output enable signal VOE changes from "H" to "L", and hence a scanning voltage is applied to the scanning line $G_1$. As a result, the writing of the voltage with respect to the pixel 6*a* begins. At the time t23, the latch signal STB falls. Here, the level of the polarity inverting signal POL is "L". Therefore, the polarity of the pixel voltage applied to the data line $S_1$ begins to change from positive to negative. As shown in FIG. 4B, the pixel voltage changes gradually due to the parasitic capacitance and the parasitic resistance of the data line 4. The voltage applied to the pixel 6*a* also changes gradually according to the change in the pixel voltage.

At the time t24, the horizontal period with respect to the scanning line $G_1$ ends, and a horizontal period with respect to the scanning line $G_2$ starts. The pixel 6*a* holds the voltage being applied at the time t24 as the holding voltage. It should be noted that, as shown in FIG. 4B, the pixel voltage applied to the data line $S_1$ is still changing at the time t24. Therefore, the holding voltage of the pixel 6*a* does not yet reach a maximum value. The difference between the holding voltage of the pixel 6*a* and the maximum value is referred to as "V3", as indicated in FIG. 4B.

At the time t25, a writing period with respect to the scanning line $G_2$ starts. At the time t26, the latch signal STB falls. Since the level of the polarity inverting signal POL is still "L", the polarity of the pixel voltage applied to the data line $S_1$ still remains in negative. At the time t27, the horizontal period with respect to the scanning line $G_2$ ends. The pixel 6*b* holds the voltage being applied at the time t27 as the holding voltage. The difference between the holding voltage of the pixel 6*b* and the maximum value is referred to as "V4", as indicated in FIG. 4B. It should be noted that the difference voltage V4 is smaller than the difference voltage V3 because the polarity inverting signal POL is constant during the horizontal periods for both the pixel 6*a* and the pixel 6*b*.

At the time t27, the level of the polarity inverting signal POL changed from "L" to "H" (2-line inversion driving method). Thereafter, the latch signal STB falls at the time t29. In response to that, the polarity of the pixel voltage applied to the data line $S_1$ begins to change from negative to positive as shown in FIG. 4B.

As described above, in the case when the level of the scanning reversal signal VREV is "H", namely, in the first mode, the pixel 6*b* is driven after the pixel 6*a* is driven.

FIG. 4C shows operations of the liquid crystal display 100 in the third frame. In FIG. 4C, the same parameters as in FIG. 4A are shown, and overlapping explanations will be properly omitted. At the time t3, the scan start signal STV rises, and hence the third frame is commenced. At the same time, the level of the scanning reversal signal VREV changes from "H" (first mode) to "L" (second mode).

The operations in the third frame are the same as in the first frame (see FIG. 4A) except for the order of the scan of the scanning line $G_1$ and the scanning line $G_2$. That is to say, a horizontal period with respect to the scanning line $G_2$ starts at the time t31. At the time t32, a writing period with respect to the scanning line $G_2$ starts. At the time t34, the horizontal period and the writing period with respect to the scanning line $G_2$ end. At this time, the difference between a holding voltage of the pixel 6*b* and a maximum value is "V1".

Also, at the time t34, a horizontal period with respect to the scanning line $G_1$ starts, and at the time t35, a writing period with respect to the scanning line $G_1$ starts. At the time t37, the horizontal period and the writing period with respect to the scanning line $G_1$ end. At this time, the difference between a holding voltage of the pixel 6*a* and a maximum value is "V2". It should be noted that the difference voltage V2 is smaller than the difference voltage V1 because the polarity inverting signal POL is constant during the horizontal periods for both the pixel 6*b* and the pixel 6*a*.

FIG. 4D shows operations of the liquid crystal display 100 in the fourth frame. In FIG. 4D, the same parameters as in FIG. 4B are shown, and overlapping explanations will be properly omitted. At the time t4, the scan start signal STV rises, and hence the fourth frame is commenced. The level of the scanning reversal signal VREV remains in "L".

The operations in the fourth frame are the same as in the second frame (see FIG. 4B) except for the order of the scan of the scanning line $G_1$ and the scanning line $G_2$. That is to say, a horizontal period with respect to the scanning line $G_2$ starts at the time t41. At the time t42, a writing period with respect to the scanning line $G_2$ starts. At the time t44, the horizontal period and the writing period with respect to the scanning line $G_2$ end. At this time, the difference between a holding voltage of the pixel 6*b* and a maximum value is "V3".

Also, at the time t44, a horizontal period with respect to the scanning line $G_1$ starts, and at the time t45, a writing period with respect to the scanning line $G_1$ starts. At the time t47, the horizontal period and the writing period with respect to the scanning line $G_1$ end. At this time, the difference between a holding voltage of the pixel 6*a* and a maximum value is "V4". It should be noted that the difference voltage V4 is smaller than the difference voltage V3 because the polarity inverting signal POL is constant during the horizontal periods for both the pixel 6*b* and the pixel 6*a*.

As described above, in the case when the level of the scanning reversal signal VREV is "L", namely, in the second mode, the pixel 6*a* is driven after the pixel 6*b* is driven.

Figure 5:
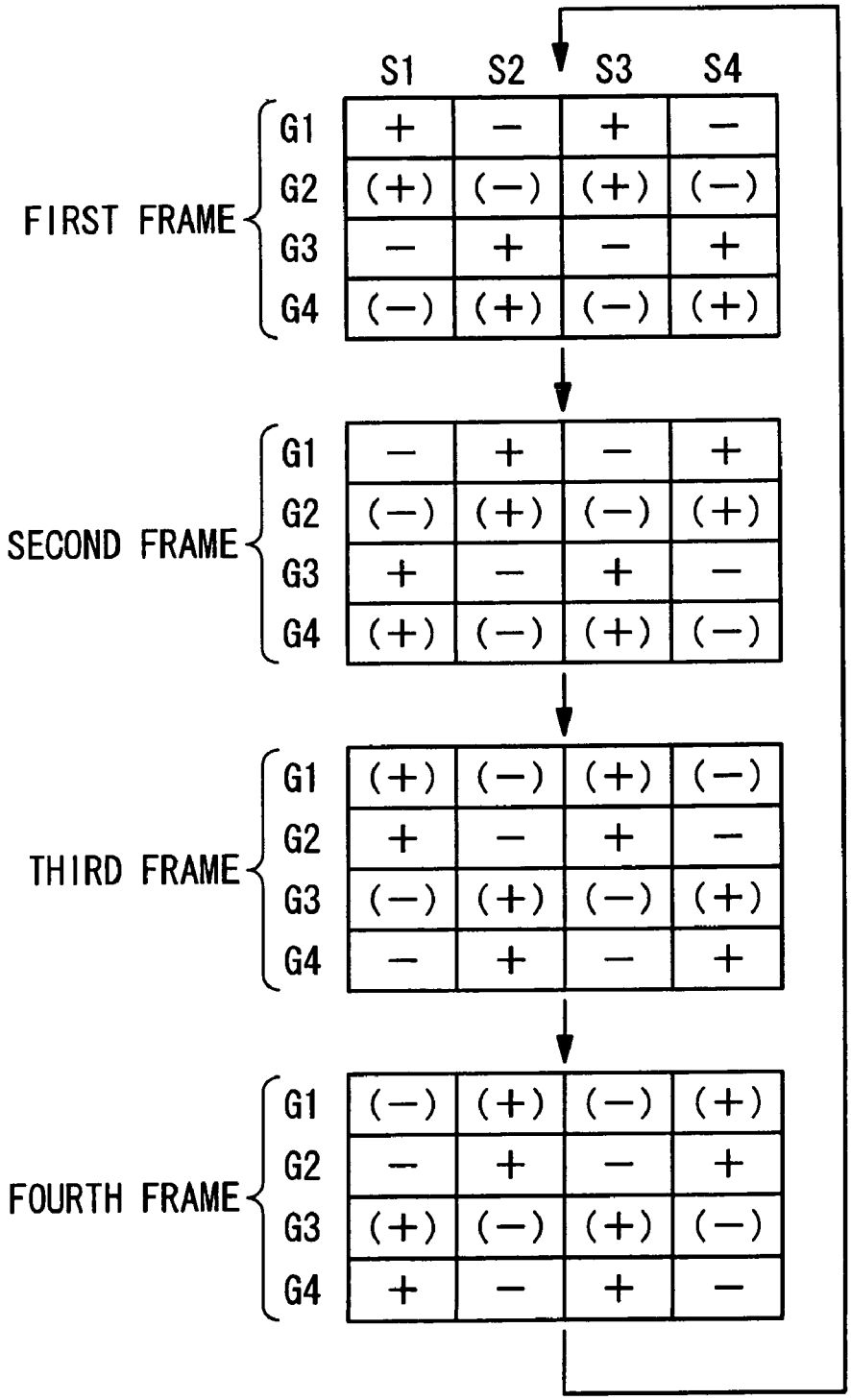
FIG. 5 is an explanatory diagram showing a method of driving the liquid crystal display according to the present invention.

The above-mentioned driving method of the liquid crystal display 100 according to the present invention can be summarized in FIG. 5. Shown in FIG. 5 are the polarities of the pixel voltages applied to a plurality of pixels 6 associated with the scanning lines $G_1$ to $G_4$ and the data lines $S_1$ to $S_4$. A symbol "+" indicates the pixel voltage with the positive polarity, and a symbol "−" indicates the pixel voltage with the negative polarity. Also, a round bracket is added to the symbol which is associated with a scanning line to be scanned first in a pair of scanning lines (ex. the scanning lines $G_1$ and $G_2$).

As shown in FIG. 5, a polarity of a pixel voltage applied to a first data line (for example, data line $S_1$) is opposite to a polarity of a pixel voltage applied to a second data line (for example, data line $S_2$) adjacent to the first data line (namely, dot inversion driving system). Also, a polarity of a pixel voltage applied to a data line is inverted every 2 horizontal periods (namely, 2-line inversion driving method). Also, polarities of pixel voltages applied to the plurality of pixels 6 are inverted every frame (namely, frame inversion driving method). Moreover, the scanning order of the plurality of scanning lines is reversed every 2 frames. That is to say, in the first frame and the second frame (in the first mode), the scanning operations are carried out in the order of the scanning lines $G_1$, $G_2$, $G_3$, $G_4$, - - - . On the other hand, in the third frame and the fourth frame (in the second mode), the scanning operations are carried out in the order of the scanning lines $G_2$, $G_1$, $G_4$, $G_3$, - - - .

Effects and advantages of the liquid crystal display 100 and the driving method thereof according to the present invention are as follows.

As shown in FIGS. 4A to 4D, the differences between the holding voltages and the maximum voltage with regard to the pixel 6*a* are V1, V3, V2, and V4 in the first, second, third, and fourth frame, respectively. An average difference with regard to the pixel 6*a* is given as (V1+V3+V2+V4)/4. On the other hand, the differences between the holding voltages and the maximum voltage with regard to the pixel 6*b* are V2, V4, V1, and V3 in the first, second, third, and fourth frame, respectively. An average difference with regard to the pixel 6*b* is given as (V2+V4+V1+V3)/4. Thus, the average difference voltage related to the pixel 6*a* is equal to the average difference voltage related to the pixel 6*b*. This implies that luminance at the pixel 6*a* is made equal to luminance at the pixel 6*b*. As for the other pixels 6, a similar condition to that of the pair of the pixels 6*a* and 6*b* occurs. As a consequence, the occurrence of lateral stripes and irregularities on the display screen can be suppressed.

Also, it is not necessary to adjust the duration time of the output enable signal VOE in order to erase the lateral stripes on the display screen. In other words, it is not necessary to fine-tune the duration time of the output enable signal VOE with checking lateral stripes occurred on the display screen with eyes. Or, it is not necessary to install a circuit for adjusting the duration time of the output enable signal VOE. Such adjustments require heavy work loads, because the characteristics of the liquid crystal panel 1 and the circuits vary depending upon the products. According to the liquid crystal display 100 and the driving method thereof in the present invention, the occurrence of the lateral stripes on the display screen can be suppressed without adjusting the "writing period".

Moreover, as shown in FIGS. 4A to 4D, it is not necessary to shorten the writing period for the secondary driven pixel 6 (for instance, the pixel 6*b* in FIG. 4A). In other words, it is not necessary to adjust the duration time of the output enable signal VOE in order to match the luminance at the plurality of pixels 6 with each other. It is therefore possible to set the writing period for the pixels 6 to as large value as possible. This implies that the holding voltage of the pixel 6 becomes close to the maximum voltage. Therefore, according to the liquid crystal display 100 and the driving method thereof in the present invention, the contrast of the image displayed on the screen is improved.

Furthermore, as shown in FIGS. 4A to 4D, it is not necessary to precharge the secondary driven pixel 6 (for instance, pixel 6*b* in FIG. 4A). As a result, the currents used for charging and discharging the parasitic capacitance of the data line 4 can be reduced. Therefore, according to the liquid crystal display 100 and the driving method thereof in the present invention, the power consumption can be reduced.

It should also be understood that the driving method for switching the first mode and the second mode every 2 frames is not limited to the driving method represented in FIGS. 4A to 4D. For example, the level of the scanning reversal signal VREV may be set to "H" in the first frame and the fourth frame, and the level of the scanning reversal signal VREV may be set to "L" in the second frame and the third frame.

Also, instead of the 2-line inversion driving method, the polarity of the pixel voltage applied to the data line may be inverted every N horizontal periods (will be referred to as "N-line inversion driving method" hereinafter). Here, the N is an integer equal to or larger than 2. The level of the polarity inverting signal POL is constant over N horizontal periods during which the scanning lines $G_{Ni+1}$ to $G_{Ni+N}$ are scanned (i is an integer not less than 0 and not larger than m/N−1). When the "i" increases by 1, the polarity inverting signal POL is inverted. In the first mode (VREV="H"), these scanning lines are sequentially scanned in an order of $G_{Ni+1}$, $G_{Ni+2}$, - - - , $G_{Ni+N-1}$, and $G_{Ni+N}$. On the other hand, in the second mode (VREV="L"), these scanning lines are sequentially scanned in an order of $G_{Ni+N}$, $G_{Ni+N-1}$, - - - , $G_{Ni+2}$, and $G_{Ni+1}$. For instance, in the case that N=3, the plurality of scanning lines $G_1$ to $G_m$ are sequentially scanned in an order of $G_1$, $G_2$, $G_3$, $G_4$, $G_5$, $G_6$, $G_7$, $G_8$, $G_9$, - - - , in the first mode. On the other hand, the plurality of scanning lines $G_1$ to $G_m$ are sequentially scanned in an order of $G_3$, $G_2$, $G_1$, $G_6$, $G_5$, $G_4$, $G_9$, $G_8$, $G_7$, - - - , in the second mode.

Next, examples of the data line driver 2, the scanning line driver 3 and the controller 10 in the liquid crystal display 100 according to the present invention will be described below.

Figure 6:
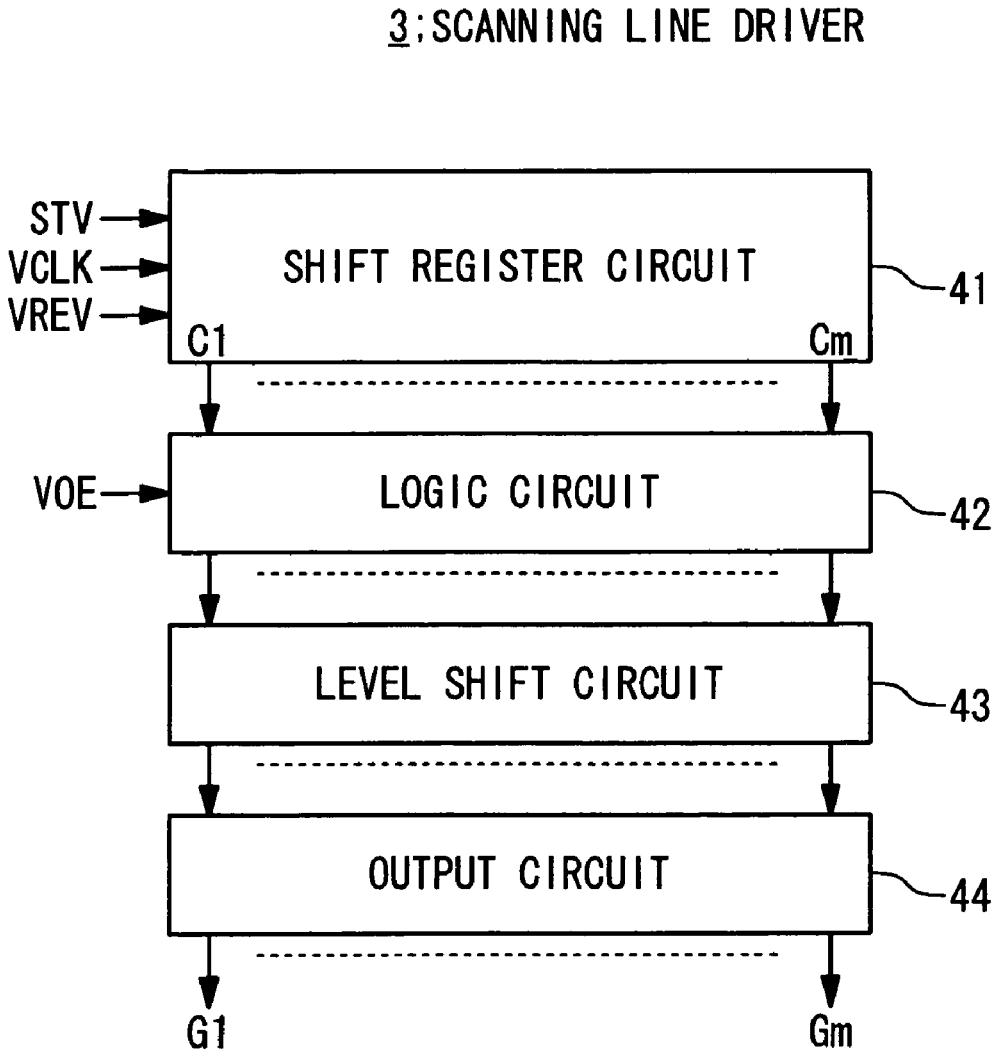
FIG. 6 is a block diagram showing an example of a configuration of a scanning line driver according to the present invention.

FIG. 6 is a block diagram showing an example of a configuration of the scanning line driver 3 according to the present invention. In FIG. 6, the scanning line driver 3 includes a shift register circuit 41, a logic circuit 42, a level shift circuit 43, and an output circuit 44. A configuration of the shift register circuit 41 can be switched as will be discussed later. The scan start signal STV, the scan clock signal VCLK and the scanning reversal signal VREV are supplied to the shift register circuit 41. In response to these signals, the shift register circuit 41 outputs the scanning signals via output lines $C_1$ to $C_m$ to the logic circuit 42. The logic circuit 42 receives the output enable signal VOE as well as the scanning signals supplied from the shift register circuit 41. As previously explained, the logic circuit 42 does not output the scanning signals when the level of the output enable signal VOE is "H". To the contrary, the logic circuit 42 outputs the scanning signals when the level of the output enable signal VOE is "L". The outputted scanning signals are level-adjusted by the level shift circuit 43. After that, the adjusted scanning signals are outputted from the output unit 44 to the plurality of scanning lines $G_1$ to $G_m$.

Figure 7A:
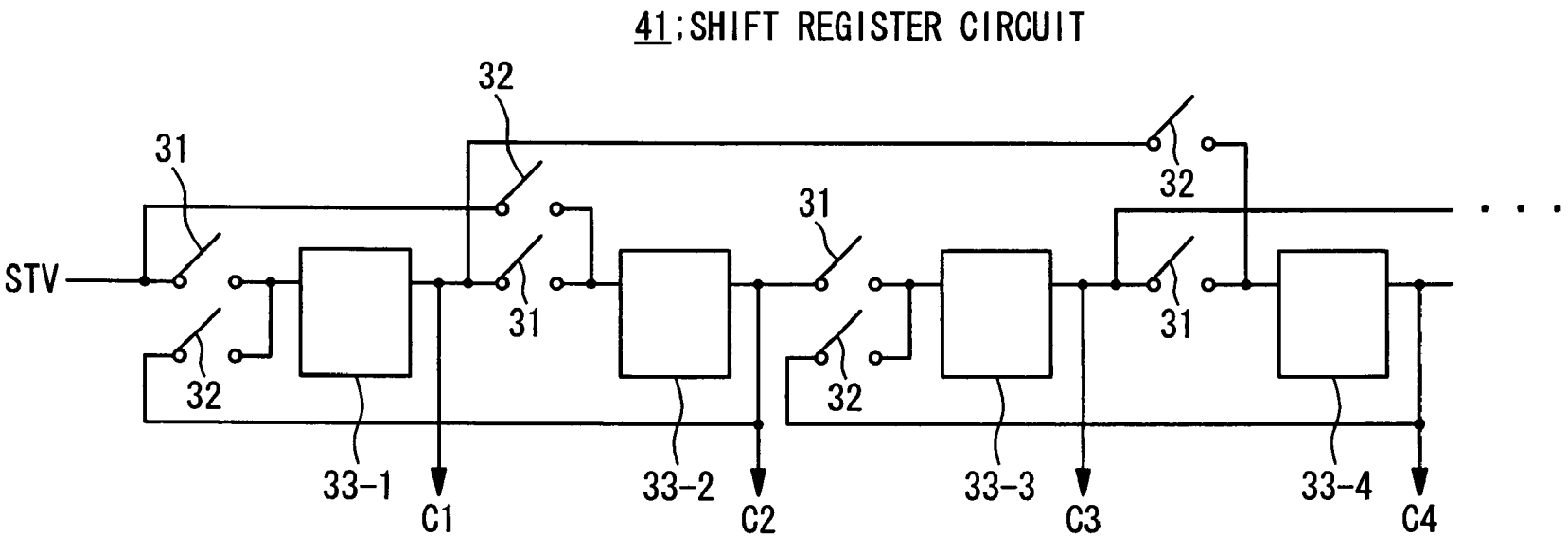
FIG. 7A is a circuit diagram showing an example of a shift register circuit according to the present invention.

FIG. 7A is a circuit diagram showing a configuration example as to the shift register circuit 41. Here, the number of the plurality of scanning lines $G_1$ to $G_m$ is 2M (M is a natural number; 2M=m). The shift register circuit 41 has 2M flip-flop circuits 33 (33-1, 33-2, - - - , 33-2M), 2M output lines ($C_1$, $C_2$, - - - , $C_{2M}$), a plurality of switches 31, and a plurality of switches 32. The outputs of these flip-flop circuits 33-1 to 33-2M are connected to the plurality of scanning lines $G_1$ to $G_{2M}$ through the output lines $C_1$ to $C_{2M}$, respectively. In FIG. 7A, the arrangement of the flip-flop circuits 33-1 to 33-4, and the output lines $C_1$ to $C_4$ is shown.

After the shift register circuit 41 receives the scan start signal STV, the inputted scan start signal STV sequentially shifts in synchronization with the scan clock signal VCLK. In the shift register circuit 41, any one of a group of the switches 31 and a group of the switches 32 is set to "ON" according to the operation mode (namely, the first mode and the second mode). That is to say, the connection relationship between the 2M flip-flop circuits 33 is switched according to the operation mode. As a result, the order in which the scan start signal STV is outputted to the output lines $C_1$ to $C_{2M}$ is switched.

When the level of the scanning reversal signal VREV is "H" (first mode), the plurality of switches 31 are set to "ON", and the plurality of switches 32 are set to "OFF". As a result, an input and an output of the 2i-th (i is an integer not less than 1 and not more than M−1) flip-flop circuit 33-2*i* are connected to an output of the (2i−1)-th flip-flop circuit 33-(2i−1) and an input of the (2i+1)-th flip-flop circuit 33-(2i+1), respectively. For instance, in FIG. 7A (i=1), the input and the output of the flip-flop circuit 33-2 are connected to the output of the flip-flop circuit 33-1 and the input of the flip-flop circuit 33-3, respectively. In this case, the scan start signal STV inputted to the flip-flop circuit 33-1 is first outputted from the output line $C_1$. In response to the next clock, the scan start signal STV is supplied to the flip-flop circuit 33-2 and then outputted from the output line $C_2$. In this manner, the plurality of scanning lines $G_1$ to $G_{2M}$ are sequentially scanned in the order of $G_1$, $G_2$, $G_3$, - - - , in the first mode.

When the level of the scanning reversal signal VREV is "L" (second mode), the plurality of switches 31 are set to "OFF", and the plurality of switches 32 are set to "ON". As a result, the input and the output of the (2i−1)-th flip-flop circuit 33-(2i−1) are connected to the output of the (2i)-th flip-flop circuit 33-2*i* and the input of the (2i+2)-th flip-flop circuit 33-(2i+2), respectively. For instance, in FIG. 7A (i=1), the input and the output of the flip-flop circuit 33-1 are connected to the output of the flip-flop circuit 33-2 and the input of the flip-flop circuit 33-4, respectively. In this case, the scan start signal STV inputted to the flip-flop circuit 33-2 is first outputted from the output line $C_2$. In response to the next clock, the scan start signal STV is supplied to the flip-flop circuit 33-1 and then outputted from the output line $C_1$. In this manner, the plurality of scanning lines $G_1$ to $G_{2M}$ are sequentially scanned in the order of $G_2$, $G_1$, $G_4$, $G_3$, - - - , in the second mode.

Figure 7B:
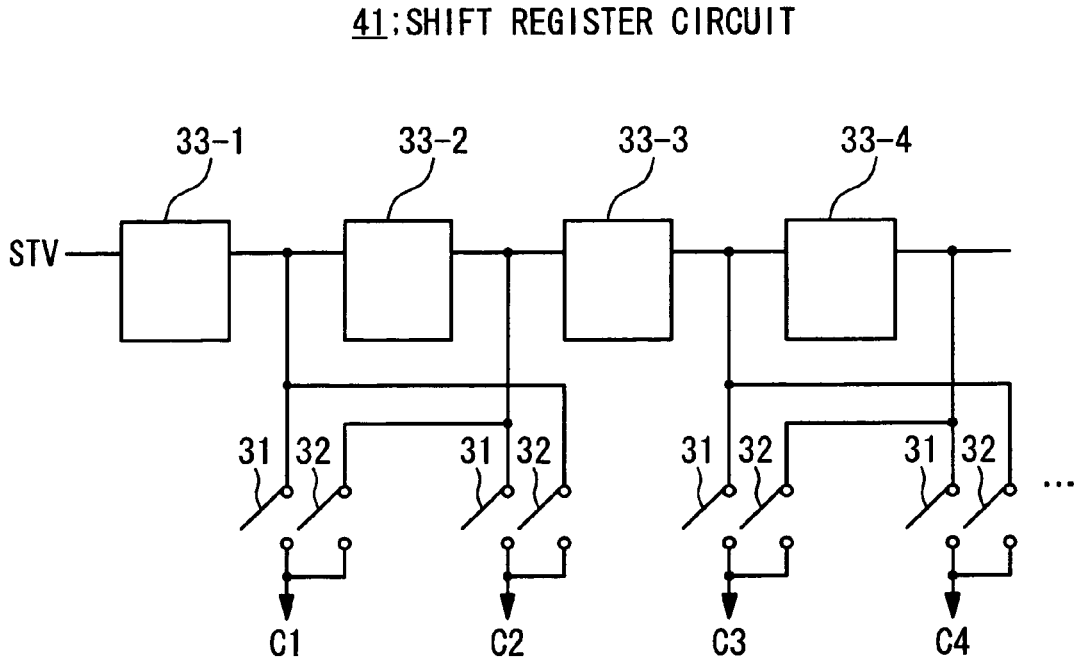
FIG. 7B is a circuit diagram showing another example of a shift register circuit according to the present invention.

FIG. 7B is a circuit diagram showing another configuration example as to the shift register circuit 41. The shift register circuit 41 has 2M flip-flop circuits 33 (33-1, 33-2, - - - , 33-2M), 2M output lines ($C_1$, $C_2$, - - - , $C_{2M}$), a plurality of switches 31, and a plurality of switches 32. The flip-flop circuits 33-1 to 33-2M are serially connected to. Also, the output lines $C_1$ to $C_{2M}$ are connected to the scanning lines $G_1$ to $G_{2M}$, respectively. In FIG. 7B, the arrangement of the flip-flop circuits 33-1 to 33-4 and the output lines $C_1$ to $C_4$ is shown.

When the level of the scanning reversal signal VREV is "H" (first mode), the plurality of switches 31 are set to "ON", and the plurality of switches 32 are set to "OFF". As a result, an output of the (2i−1)-th (i is an integer not less than 1 and no more than M) flip-flop circuit 33-(2i−1) is connected to the (2i−1)-th output line $C_{2i-1}$, and an output of the (2i)-th flip-flop circuit 33-2*i* is connected to the (2i)-th output line $C_{2i}$. For example, in FIG. 7B (i=1), the output of the flip-flop circuit 33-1 is connected to the output line $C_1$, and the output of the flip-flop circuit 33-2 is connected to the output line $C_2$. In this case, the scan start signal STV inputted to the flip-flop circuit 33-1 is first outputted from the output line $C_1$. In response to the next clock, the scan start signal STV is supplied to the flip-flop circuit 33-2, and then outputted from the output line $C_2$. In this manner, the plurality of scanning lines $G_1$ to $G_{2M}$ are sequentially scanned in the order of $G_1$, $G_2$, $G_3$, - - - , in the first mode.

When the level of the scanning reversal signal VREV is "L" (second mode), the plurality of switches 31 are set to "OFF" statuses and the plural switches 32 are set to "ON" statuses. As a result, the output of the (2i−1)-th flip-flop circuit 33-(2i−1) is connected to the (2i)-th output line $C_{2i}$, and the output of the (2i)-th flip-flop circuit 33-2*i* is connected to the (2i−1)-th output line $C_{2i-1}$. For instance, in FIG. 7B (i=1), the output of the flip-flop circuit 33-1 is connected to the output line $C_2$, and the output of the flip-flop circuit 33-2 is connected to the output line $C_1$. In this case, the scan start signal STV inputted to the flip-flop circuit 33-1 is first outputted from the output line $C_2$. In response to the next clock, the scan start signal STV is inputted to the flip-flop circuit 33-2, and then outputted from the output line $C_1$. In this manner, the plurality of scanning line $G_1$ to $G_{2M}$ are sequentially scanned in the order of $G_2$, $G_1$, $G_4$, $G_3$, - - - , in the second mode.

As described above, according to the scanning line driver 3 (shift register circuit 44) shown in FIG. 7A or FIG. 7B, the order of scanning the plurality of scanning lines $G_1$ to $G_{2M}$ is switched in accordance with the operation mode. As a result, the method of driving the liquid crystal display 100 according to the present invention is realized.

Since the order of scanning the plurality of scanning lines $G_1$ to $G_M$ is switched according to the operation mode, an order of outputting image data by the data line driver 2 is controlled to match the order of the scanning. An example is shown below, in which such a control of outputting the image data is carried out by the controller 10. As shown in FIG. 1, the controller 10 receives image data DA1 to DAn in response to the horizontal sync signal $H_{sync}$ and the dot clock signal dCLK. Also, the controller 10 supplies image data DB1 to DBn to the data line driver 2 based upon these signals $H_{sync}$ and dCLK. The dot clock signal dCLK corresponds to a signal for controlling the image data in accordance with the resolution of the liquid crystal panel 1. The image data DB1 to DBn are sequentially outputted to the data line driver 2 in response to the dot clock signal dCLK.

Figure 8:
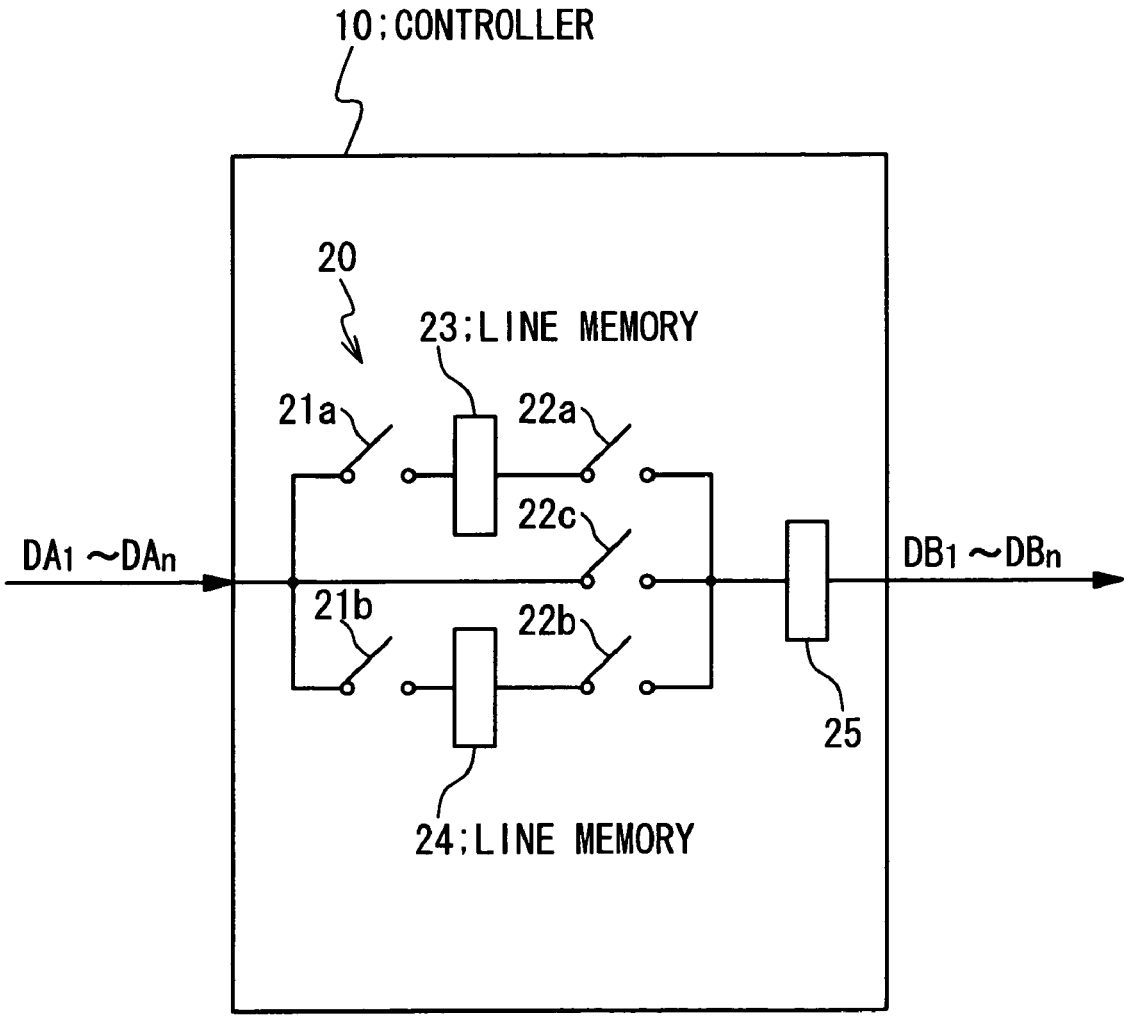
FIG. 8 is a block diagram showing an example of a configuration of a controller according to the present invention.

FIG. 8 is a block diagram schematically showing an example of a configuration of the controller 10 according to the present invention. An image data rearranging circuit 20 and a data processing circuit 25 are shown in FIG. 8. The image data rearranging circuit 20 generates the image data DB1 to DBn (will be referred to as DBn hereinafter) from the image data DA1 to DAn (will be referred to as DAn hereinafter). The data processing circuit 25 performs a predetermined process operation with respect to the image data. The image data rearranging circuit 20 of the controller 10 in FIG. 8 includes at least two line memories 23, 24, a plurality of switches 21 (21*a* and 21*b*) and a plurality of switches 22 (22*a* to 22*c*). Each of the line memories 23 and 24 stores the image data DA1 to DAn corresponding to one scanning line 5.

As shown in FIG. 8, the line memories 23, 24 and the switch 22*c* are connected in parallel. The switch 21*a* and the switch 22*a* are arranged so as to control an input and an output of the line memory 23. Also, the switch 21*b* and the switch 22*b* are arranged so as to control an input and an output of the line memory 24.

Figure 9A:
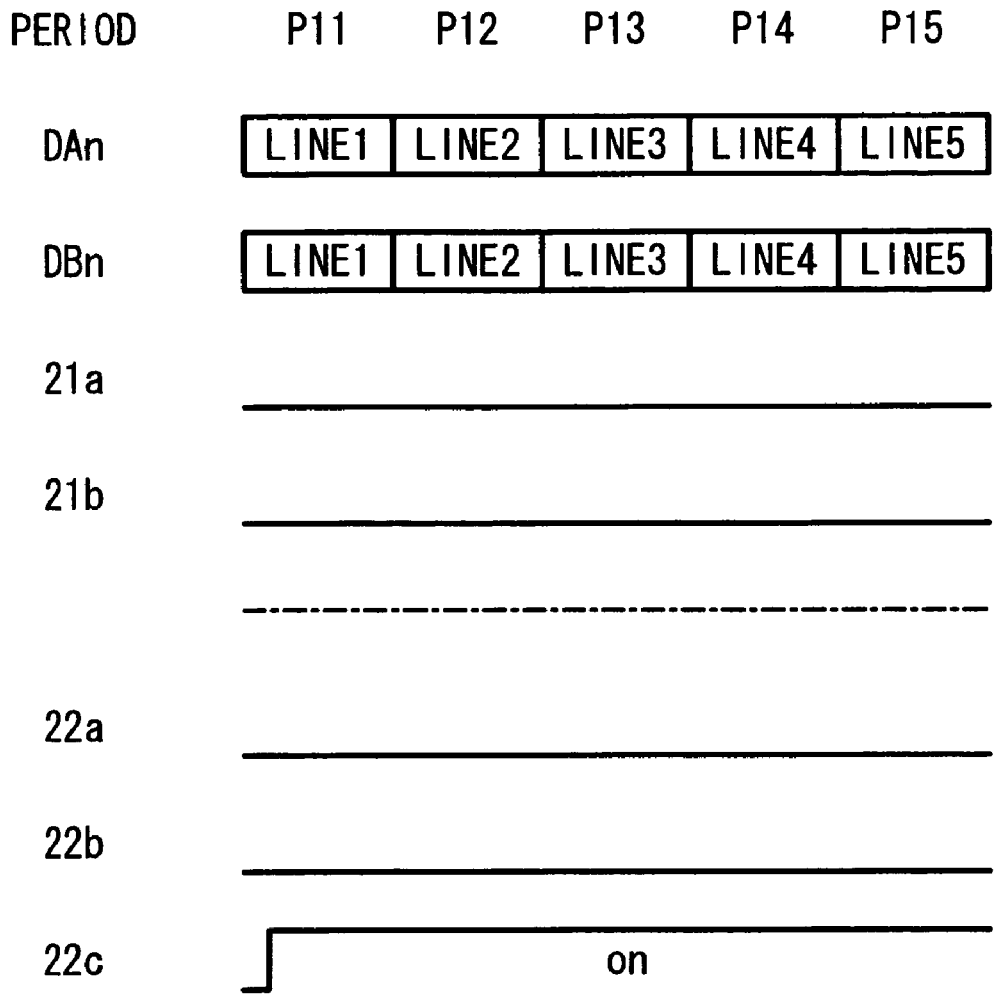
FIG. 9A is a timing chart showing an operation of the controller according to the present invention.

FIG. 9A is a timing chart showing an operation of the controller 10 in the case that the level of the scanning reversal signal VREV is "H" (first mode). More specifically, FIG. 9A shows ON/OFF statuses of the plural switches 21 and 22, and input/output statuses of the image data DAn and DBn in certain periods from P11 to P15 in the first mode. Here, "LINE1", "LINE2", - - - indicate the image data DAn/DBn corresponding to the scanning lines $G_1$, $G_2$, - - - , respectively. The controller 10 receives the image data DAn sequentially in an order of LINE1, LINE2, - - - , LINE5 in response to the horizontal sync signal $H_{sync}$.

As shown in FIG. 9A, the switches 21*a*, 21*b*, 22*a*, 22*b* are turned off and the switch 22*c* is turned on during the periods P11 to P15. As a result, the inputted image data DAn are directly outputted as the image data DBn after the predetermined process operation is carried out in the data processing circuit 25. That is to say, the image data DBn are outputted to the data line driver 2 in the order of LINE1, LINE2, - - - , LINE5.

Figure 9B:
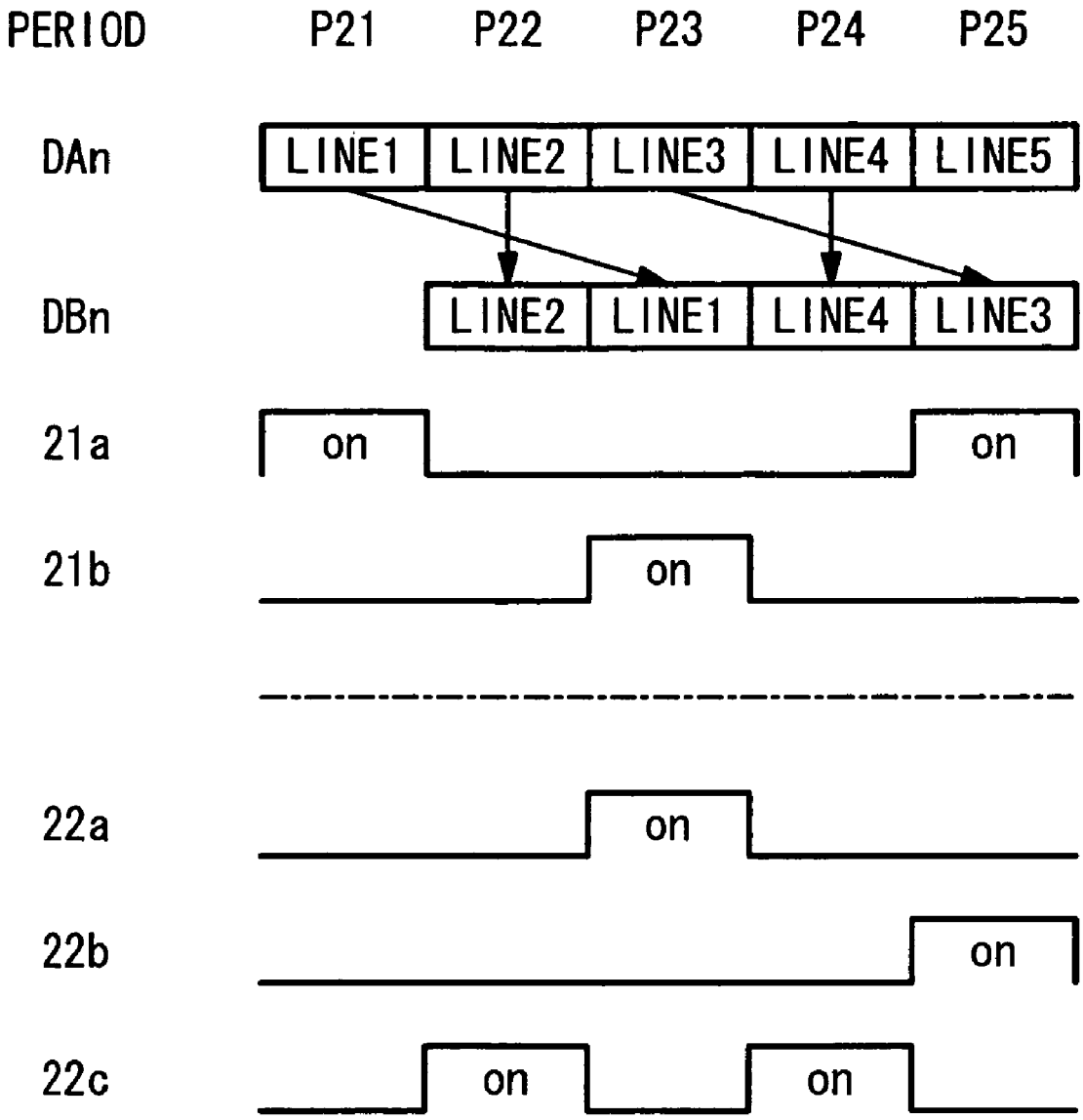
FIG. 9B is a timing chart showing an operation of the controller according to the present invention.

On the other hand, FIG. 9B is a timing chart showing an operation of the controller 10 in the case that the level of the scanning reversal signal VREV is "L" (second mode). More specifically, FIG. 9A shows ON/OFF statuses of the plural switches 21 and 22, and input/output statuses of the image data DAn and DBn in certain periods from P21 to P25 in the second mode. As in the case of FIG. 9A, the controller 10 receives the image data DAn sequentially in an order of LINE1, LINE2, - - - , LINE5 in response to the horizontal sync signal $H_{sync}$.

As shown in FIG. 9B, the switch 21*a* is turned on and the other switches are turned off in the period P21. As a result, the LINE1 is stored in the line memory 23. In the period P22, the switch 22*c* is turned on, and the other switches are turned off. As a result, the LINE2 is directly outputted to the data line driver 22 as the image data DBn through the data processing circuit 25. In the period P23, the switch 22*a* and the switch 21*b* are turned on, and the other switches are turned off. As a result, the LINE1 stored in the line memory 23 is outputted as the image data DBn. At the same time, the LINE3 is stored in the line memory 24. In the period P24, the switch 22*c* is turned on, and the other switches are turned off. As a result, the LINE4 is directly outputted to the data line driver 2 as the image signal DBn. In the period P25, the switch 22*b* and the switch 21*a* are turned on, and the other switches are turned off. As a result, the LINE3 stored in the line memory 24 is outputted as the image signal DBn. At the same time, the LINE5 is stored in the line memory 23. Subsequently, similar switching operations are repeatedly carried out.

As described above, the image data DBn are outputted to the data line driver 2 in an order of LINE2, LINE1, LINE4, LINE3, - - - , in the second mode. This order of outputting the image data DBn in the second mode matches with the above-mentioned order of scanning by the scanning line driver 3 in the second mode. The controller 10 controls the plurality of switches 21 and 22 together with the scanning line driver 3. Thus, the image data corresponding to the plurality of pixels 6 are supplied.

Figure 9C:
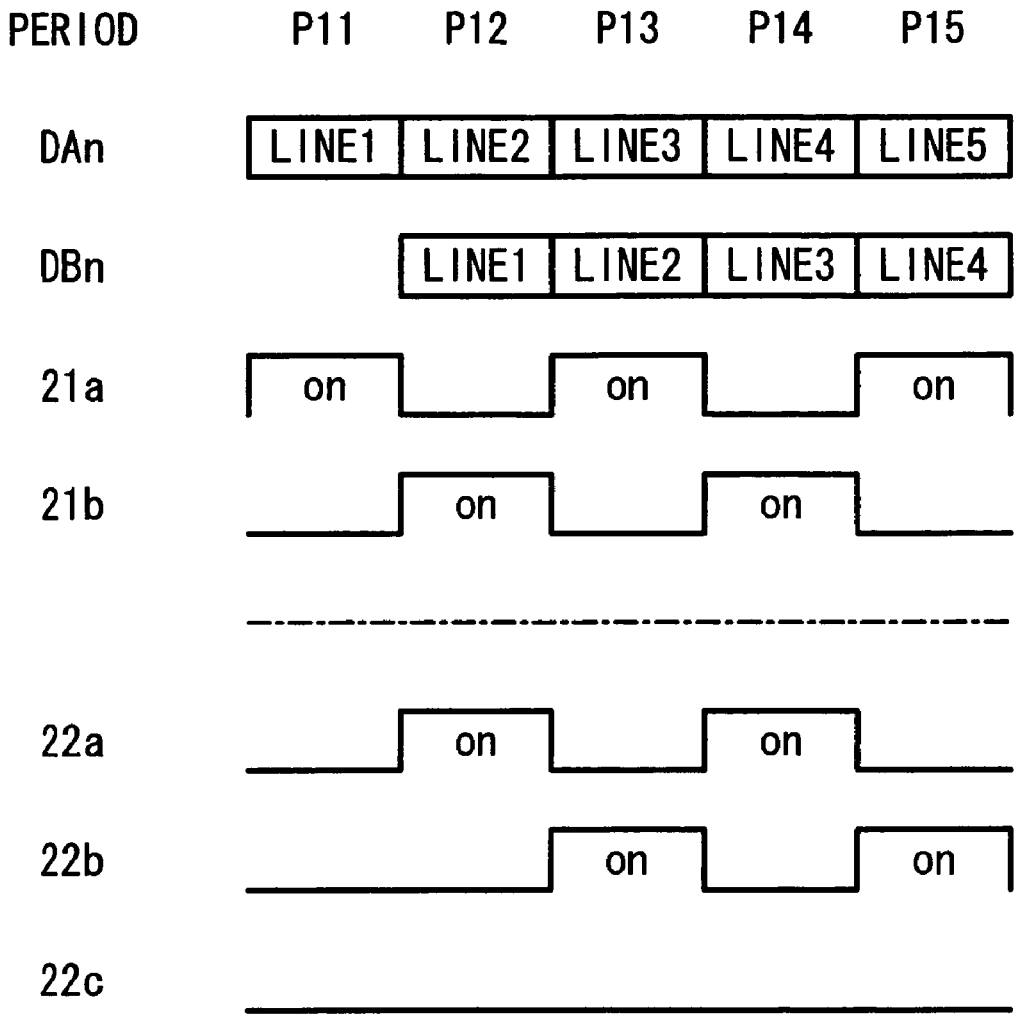
FIG. 9C is a timing chart showing an operation of the controller according to the present invention.

FIG. 9C is a timing chart showing another example of an operation of the controller 10 in the case that the level of the scanning reversal signal VREV is "H" (first mode). In the period P11, the switch 21*a* is turned on, and the LINE1 is stored in the line memory 23. In the period P12, the switch 21*b* and the switch 22*a* are turned on. As a result, the LINE1 stored in the line memory 23 is outputted to the data line driver 2, and the LINE2 is stored in the line memory 24. In the period P13, the switch 21*a* and the switch 22*b* are turned on. As a result, the LINE2 stored in the line memory 24 is outputted to the data line driver 2, and the LINE3 is stored in the line memory 23. Subsequently, a similar switching operation is repeatedly carried out. As in the case of FIG. 9A, the image data DBn are outputted to the data line driver 2 in the order of LINE1, LINE2, - - - , LINE5.

As described above, according to the controller 10 (image data rearranging circuit 20) shown in FIG. 8 and FIGS. 9A to 9C, the order of outputting the image data DBn is switched in accordance with the operation mode. By combining the controller 10 with the scanning line driver 3 mentioned above, the method of driving the liquid crystal display 100 according to the present invention is realized. If it is necessary to rearrange the image data in the case of N scanning lines 5, the image data rearranging circuit 20 should include N line memories. Also in such a case, a switching operation similar to the above-mentioned switching operation is carried out.

Figure 10:
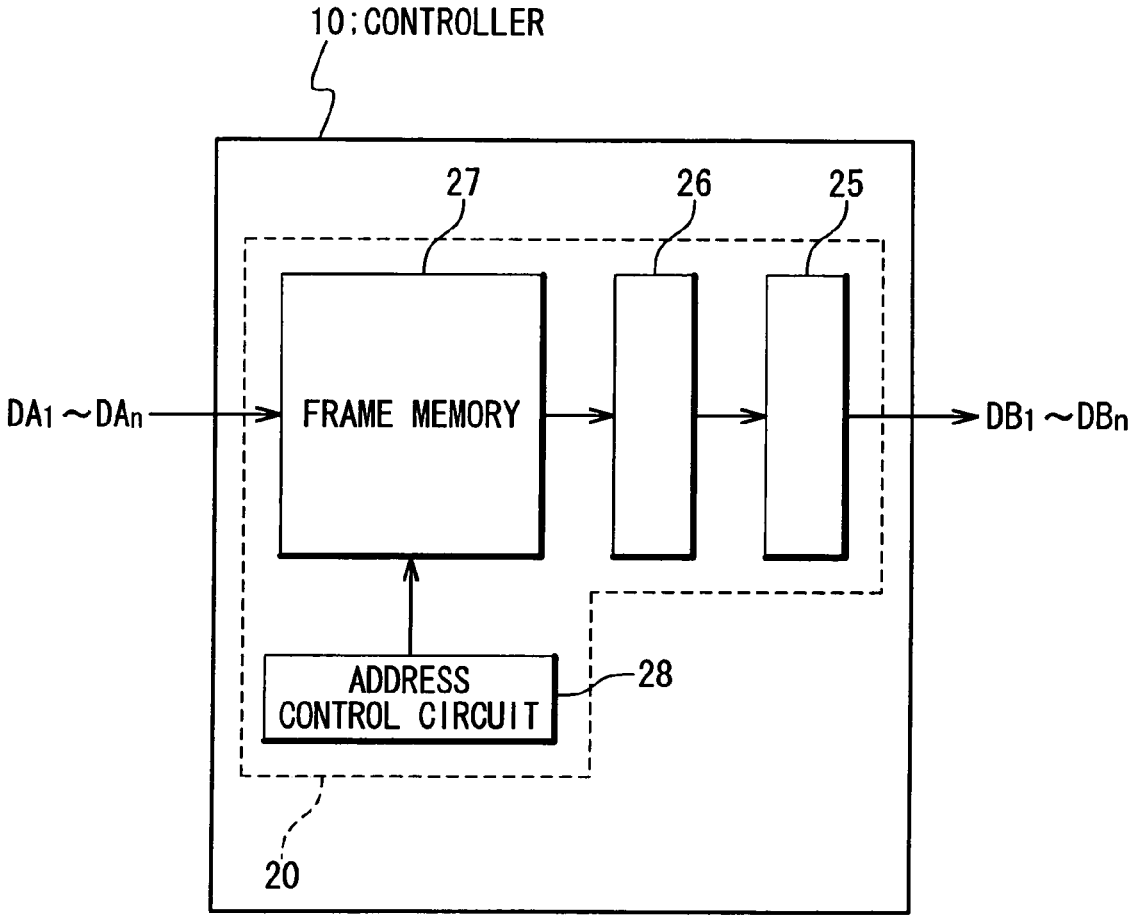
FIG. 10 is a block diagram showing another example of a configuration of a controller according to the present invention.

FIG. 10 is a block diagram schematically showing another example of a configuration of the controller 10 according to the present invention. The controller 10 has an image data rearranging circuit 20. In FIG. 10, the image data rearranging circuit 20 includes a frame memory 27, an address control circuit 28, a line memory 26, and a data processing circuit 25. The frame memory 27 stores image data corresponding to one frame. The address control circuit 28 controls the frame memory 27 such that image data corresponding to one scanning line is outputted to the line memory 26. The image data stored in the line memory 26 is outputted to the data line driver 2 as image data DBn after a predetermined process operation is carried out in the data processing circuit 25.

In the case that the level of the scanning reversal signal VREV is "H" (first mode), the address control circuit 28 controls the frame memory 27 such that the image data DBn are sequentially supplied to the data line driver 2 in the order of LINE1, LINE2, - - - . In the case that the level of the scanning reversal signal VREV is "L" (second mode), the address control unit 28 controls the frame memory 27 such that the image data DBn are sequentially supplied to the data line driver 2 in the order of LINE2, LINE1, LINE4, LINE3, - - - . As explained above, by combining the controller 10 shown in FIG. 10 with the scanning line driver 3 mentioned above, the method of driving the liquid crystal display 100 according to the present invention is realized.

Figure 11:
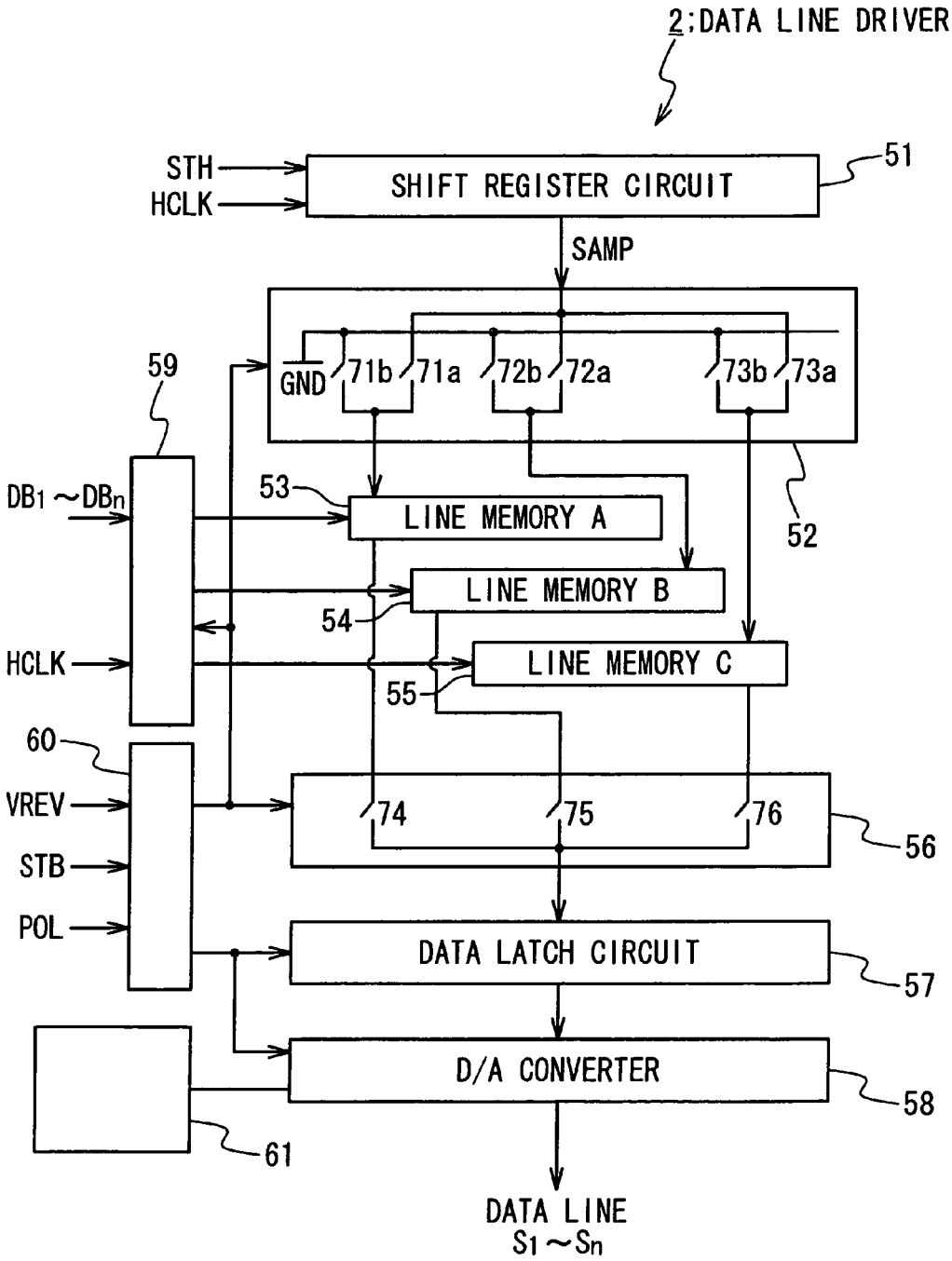
FIG. 11 is a block diagram showing an example of a configuration of a data line driver according the present invention.

Since the order of scanning the plurality of scanning lines $G_1$ to $G_M$ is switched according to the operation mode, an order of outputting image data by the data line driver 2 is controlled to match the order of the scanning. An example is shown below, in which such a control of outputting the image data is carried out in the data line driver 2. FIG. 11 is a block diagram showing an example of a configuration of the data line driver 2 according to the present invention.

As shown in FIG. 11, the data line driver 2 has a shift register circuit 51, a switching circuit 52, a plurality of line memories (line memory-A 53, line memory-B 54, and line memory-C 55), a switching circuit 56, a data latch circuit 57, a D/A converter 58, a data buffer circuit 59, a data line control circuit 60, and a gamma voltage generating circuit 61.

The horizontal start signal STH and the horizontal clock signal HCLK are supplied from the controller 10 to the shift register circuit 51. When receiving the horizontal start signal STH, the shift register circuit 51 generates a sampling signal SAMP which is in synchronization with the horizontal clock signal HCLK.

The switching circuit 52 includes a plurality of switches 71*a* to 73*a* and 71*b* to 73*b*. As will be explained later, the switching circuit 52 supplies any of the sampling signal SAMP generated by the shift register circuit 51 and a fixed voltage GND to any one of the plurality of line memories 53, 54 and 55. When the switch 71*a* is turned on, switch 71*b* is turned off. Conversely, when the switch 71*a* is turned off, the switch 71*b* is turned on. The switches 72*a* and 72*b* operate in the same way. Also, the switches 73*a* and 73*b* operate in the same way.

Each of the line memory (A) 53, the line memory (B) 54 and the line memory (C) 55 stores the image data DB1 to DBn (will be referred to as DBn hereinafter) which correspond to one scanning line 5. As shown in FIG. 11, the plurality of line memories 53, 54 and 55 are arranged in parallel. The line memories 53, 54 and 55 are connected to the switches 71, 72 and 73, respectively. The data buffer circuit 59 latches the image data DBn outputted from the controller 10 in synchronization with the horizontal clock signal HCLK. The image data DBn stored in the data buffer circuit 59 are supplied to any one of the plurality of line memories 53, 54 and 55 in synchronization with the sampling signal SAMP.

In response to the latch signal STB generated by the controller 10, the data latch circuit 57 latches the image data DBn stored in any one of the plurality of line memories 53, 54 and 55. The switching circuit 56 is connected between the data latch circuit 57 and the plurality of line memories 53, 54 and 55. The switching circuit 56 includes a plurality of switches 74, 75 and 76. By switching these switches 74, 75 and 76, any one of the line memories 74, 75 and 76 is selected as a selected line memory. The image data DBn stored in the selected line memory is supplied to the data latch circuit 57.

The image data DBn latched by the data latch circuit 57 are converted by the D/A converter 58, and then the produced analog image data are outputted to the plurality of data line $S_1$ to $S_n$. The gamma voltage generating circuit 61 connected to the D/A converter 58 is a circuit which produces a desirable gradation voltage beforehand for the purpose of matching the image data with a gamma characteristic. The data line control circuit 60 receives the latch signal STB, the polarity inverting signal POL and the scanning reversal signal VREV, and controls the switching circuit 52, the switching circuit 56, the data latch circuit 57, the D/A converter 58, and the data buffer circuit 59 mentioned above.

Figure 12:
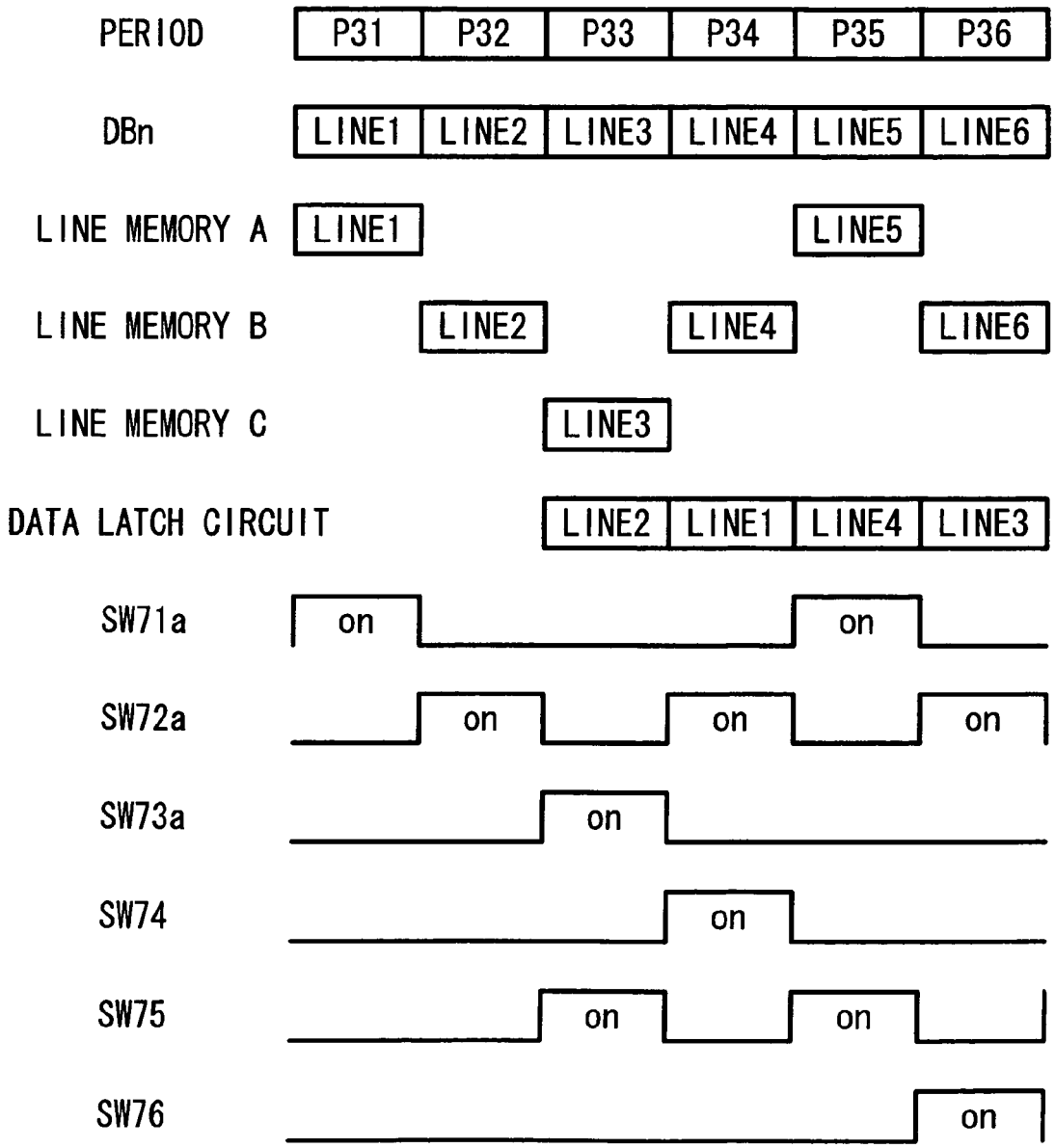
FIG. 12 is a timing chart showing an operation of the data line driver according to the present invention.

FIG. 12 is a timing chart showing an operation of the data line driver 2 in the case that the level of the scanning reversal signal VREV is "L" (second mode). More specifically, FIG. 12 shows an operation of the data line driver 2 in certain periods P31 to P32 in the second mode. Shown in FIG. 12 are the image data DBn to be inputted, data to be stored in the plurality of line memories 53 to 55, data latched by the data latch circuit 57, ON/OFF statuses of the plurality of switches 71 to 76 (SW71*a*, SW72*a*, SW73*a*, SW74, SW75, SW76). Here, "LINE1", "LINE2", - - - indicate the image data DBn corresponding to the scanning lines $G_1$, $G_2$, - - - , respectively. In response to the horizontal clock signal HCLK, the data buffer circuit 59 receives the image data DBn sequentially in an order of LINE1, LINE2, - - - .

In the period P31, the switch 71*a* is turned on, and the other switches are turned off. As a result, the LINE1 is stored in the line memory 53. In the period P32, the switch 72*a* is turned on, and the other switches are turned off. As a result, the LINE2 is stored in the line memory 54. In the period P33, the switch 73*a* and the switch 75 are turned on, and the other switches are turned off. As a result, the LINE3 is stored in the line memory 55. At the same time, the LINE2 which is stored in the line memory 54 is outputted to the data latch circuit 57.

In the period P34, the switch 72*a* and the switch 74 are turned on, and the other switches are turned off. As a result, the LINE4 is stored in the line memory 54, and at the same time, the LINE1 which is stored in the line memory 53 is outputted to the data latch circuit 57. In the period P35, the switch 71*a* and the switch 75 are turned on, and the other switches are turned off. As a result, the LINE5 is stored in the line memory 53, and at the same time, the LINE4 which is stored in the line memory 54 is outputted to the data latch circuit 57. In the period P36, the switch 72*a* and the switch 76 are turned on, and the other switches are turned off. As a result, the LINE6 is stored in the line memory 54, and at the same time, the LINE3 which is stored in the line memory 55 is outputted to the data latch circuit 57. Subsequently, a similar switching operation is repeatedly carried out.

As described above, in the second mode, the image data DBn are sequentially outputted to the plurality of data lines $S_1$ to $S_n$ in the order of LINE2, LINE1, LINE4, LINE3, - - - . This order of outputting the image data DBn in the second mode matches with the above-mentioned order of scanning by the scanning line driver 3 in the second mode. In the first mode, the image data DBn are outputted to the data lines $S_1$ to $S_n$ without any change in the order. In the first mode, any one of the plurality of line memories 53, 54 and 55 is employed. As described above, according to the data line driver 2 shown in FIGS. 11 and 12, the order of outputting the image data DBn is switched in accordance with the operation mode. By combining the data line driver 2 shown in FIG. 11 with the scanning line driver 3 mentioned above, the method of driving the liquid crystal display 100 according to the present invention is realized.

As explained above in detail, according to the liquid crystal display 100 and the driving method thereof in the present invention, the order of scanning the plurality of scanning lines $G_1$ to $G_m$ is switched in accordance with the operation mode. Therefore, the holding voltages held by the plurality of pixels 6 are averaged, which suppresses the occurrence of the lateral stripes and the irregularities on the display screen at the time of image display. Also, it is not necessary to adjust the duration time of the output enable signal VOE, namely the writing period for every product. Moreover, it is possible to set the writing period for the pixels 6 to as large value as possible. Thus, the contrast of the image displayed on the screen is improved. Furthermore, the precharging operation is not necessary, which reduces the power consumption.

It will be obvious to one skilled in the art that the present invention may be practiced in other embodiments that depart from the above-described specific details. The scope of the present invention, therefore, should be determined by the following claims.

What is claimed is:

1. A liquid crystal display comprising:

a plurality of scanning lines organized in sets of at least two;

a plurality of data lines overlapping said plurality of scanning lines at a plurality of intersection regions;

a plurality of pixels located at said plurality of intersection regions;

a scanning line driver configured to drive said plurality of pixels by sequentially scanning said sets of scanning lines;

a data line driver configured to apply a pixel voltage corresponding to an image data to each of said plurality of pixels through corresponding one of said plurality of data lines; and a common electrode configured to apply a reference voltage to said plurality of pixels, wherein said sets of scanning lines each include a first scanning line and a second scanning line located adjacent to each other, said plurality of pixels include a first pixel associated with said first scanning line and a second pixel associated with said second scanning line, said scanning line driver drives said second pixel after said first pixel in a first period, and drives said first pixel after said second pixel in a second period, and said data line driver inverts a polarity of said pixel voltage with regard to said reference voltage every N horizontal scanning periods (N is an integer equal to or larger than 2).

2. The liquid crystal display according to claim 1, wherein said first period includes a first frame and a second frame, said second period includes a third frame and a fourth frame, said first, second, third, and fourth frames respectively occur consecutively to each other, and said scanning line driver drives said second pixel after said first pixel in each of said first frame and said second frame, and drives said first pixel after said second pixel in each of said third frame and said fourth frame.

3. The liquid crystal display according to claim 2, wherein said N is 2.

4. The liquid crystal display according to claim 2, wherein said data line driver applies said pixel voltage such that a polarity of said pixel voltage applied to said first data line is opposite to a polarity of said pixel voltage applied to said second data line with regard to said reference voltage.

5. The liquid crystal display according to claim 2, further comprising a controller configured to supply said image data to said data line driver, wherein said image data includes a first image data associated with said first scanning line and a second image data associated with said second scanning line, and said controller supplies said second image data after said first image data to said data line driver in said first period, and supplies said first image data after said second image data to said data line driver in said second period.

6. The liquid crystal display according to claim 2, wherein a number of said plurality of scanning lines is $2^M$ (M is a natural number).

7. The liquid crystal display according to claim 6, wherein said scanning line driver includes a shift register, said shift register having $2^M$ flip-flop circuits respective of which are connected to said plurality of scanning lines, an input and an output of a 2i-th (i is an integer not less than 1 and not more than M−1) flip-flop circuit are connected to an output of a (2i−1)-th flip-flop circuit and an input of a (2i+1)-th flip-flop circuit in said first period, respectively, and an input and an output of said (2i−1)-th flip-flop circuit are connected to an output of said 2i-th flip-flop circuit and an input of a (2i+2)-th flip-flop circuit in said second period, respectively.

8. The liquid crystal display according to claim 6, wherein said scanning line driver includes a shift register, said shift register comprises:

$2^M$ flip-flop circuits serially connected; and $2^M$ output lines connected to respective of said plurality of scanning lines, an output of a (2i−1)-th (i is an integer not less than 1 and not more than M) flip-flop circuit is connected to a (2i−1)-th output line and an output of a 2i-th flip-flop circuit is connected to a 2i-th output line in said first period, and said output of said (2i−1)-th flip-flop circuit is connected to said 2i-th output line and said output of said 2i-th flip-flop circuit is connected to said (2i−1)-th output line in said second period.

9. The liquid crystal display according to claim 1, wherein said N is 2.

10. The liquid crystal display according to claim 1, wherein said data line driver applies said pixel voltage such that a polarity of said pixel voltage applied to said first data line is opposite to a polarity of said pixel voltage applied to said second data line with regard to said reference voltage.

11. The liquid crystal display according to claim 1, further comprising a controller configured to supply said image data to said data line driver, wherein said image data includes a first image data associated with said first scanning line and a second image data associated with said second scanning line, and said controller supplies said second image data after said first image data to said data line driver in said first period, and supplies said first image data after said second image data to said data line driver in said second period.

12. The liquid crystal display according to claim 1, wherein a number of said plurality of scanning lines is $2^M$ (M is a natural number).

13. The liquid crystal display according to claim 12, wherein said scanning line driver includes a shift register, said shift register having $2^M$ flip-flop circuits respective of which are connected to said plurality of scanning lines, an input and an output of a 2i-th (i is an integer not less than 1 and not more than M−1) flip-flop circuit are connected to an output of a (2i−1)-th flip-flop circuit and an input of a (2i+1)-th flip-flop circuit in said first period, respectively, and an input and an output of said (2i-1)-th flip-flop circuit are connected to an output of said 2i-th flip-flop circuit and an input of a (i+2)-th flip-flop circuit in said second period, respectively.

14. The liquid crystal display according to claim 12, said scanning line driver includes a shift register, said shift register comprises:

$2^M$ flip-flop circuits serially connected; and $2^M$ output lines connected to respective of said plurality of scanning lines, an output of a (2i−1)-th (i is an integer not less than 1 and not more than M) flip-flop circuit is connected to a (2i−1)-th output line and an output of a 2i-th flip-flop circuit is connected to a 2i-th output line in said first period, and said output of said (2i-1)-th flip-flop circuit is connected to said 2i-th output line and said output of said 2i-th flip-flop circuit is connected to said (2i−1)-th output line in said second period.

15. The liquid crystal display according to claim 1, wherein the first pixel and the second pixel each comprise an average difference voltage being a difference of the pixel voltage over the first period and the second period, and the average difference voltage for the first and second pixel is substantially equal.

16. The liquid crystal display according to claim 1, wherein the first pixel and the second pixel each comprise a writing period, and the writing period of the first and second pixels is constant.

17. The liquid crystal display according to claim 1, wherein the scanning line driver includes a shift register.

18. The liquid crystal display according to claim 17, wherein the shift register comprises a plurality of flip-flop circuits connected to the plurality of scanning lines.

19. The liquid crystal display according to claim 18, wherein the plurality of flip-flop circuits are serially connected.

20. The liquid crystal display according to claim 1, wherein, after 2×N horizontal scanning periods, an average difference voltage of the first pixel and an average difference voltage of the second pixel are substantially equal.

* * * * *